US006888296B2

(12) United States Patent
Motoi et al.

(10) Patent No.: US 6,888,296 B2
(45) Date of Patent: May 3, 2005

(54) ELECTRON-EMITTING DEVICE, ELECTRON SOURCE USING THE ELECTRON-EMITTING DEVICES, AND IMAGE-FORMING APPARATUS USING THE ELECTRON SOURCE

(75) Inventors: Taiko Motoi, Kanagawa-Ken (JP); Masato Yamanobe, Tokyo (JP); Rie Ueno, Kanagawa-Ken (JP); Toshiaki Aiba, Kanagawa-Ken (JP); Kumi Nakamura, Kanagawa-Ken (JP); Masaaki Shibata, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 70 days.

(21) Appl. No.: 10/086,334

(22) Filed: Mar. 4, 2002

(65) Prior Publication Data

US 2002/0096986 A1 Jul. 25, 2002

Related U.S. Application Data

(62) Division of application No. 09/442,994, filed on Nov. 19, 1999, now Pat. No. 6,380,665.

(30) Foreign Application Priority Data

Dec. 8, 1998 (JP) ..... 10-348232
Dec. 8, 1998 (JP) ..... 10-348438
Nov. 10, 1999 (JP) ..... 11-319290

(51) Int. Cl.[7] ..... M01J 1/05
(52) U.S. Cl. ..... 313/310; 313/311; 313/495
(58) Field of Search ..... 313/310, 311, 313/495, 497, 345, 346, 346 R, 352

(56) References Cited

U.S. PATENT DOCUMENTS 5,986,389 A 11/1999 Tsukamoto ..... 313/310
6,005,334 A 12/1999 Mitome et al. ..... 313/309
6,008,569 A 12/1999 Yamanobe ..... 313/310

(Continued)

FOREIGN PATENT DOCUMENTS

EP 0701265 3/1996
EP 0 725 413 A1 8/1996
EP 0 757 371 A2 2/1997

(Continued)

OTHER PUBLICATIONS

C.A. Mead, "Operation of Tunnel–Emission Devices", Journal of Applied Physics, Apr. 1961, pp. 646–652.

M.E. Elinson et al., "The Emission of Hot Electrons and the Field Emission of Electrons From Tin Oxide", Radio Engineering and Electronic Physics, Jul. 1965, pp. 1290–1296.

H. Araki, "Electroforming and Electron Emission of Carbon Thin Films", Journal of th Vacuum, Society of Japan, 1983, pp. 22–29 (with English Abstract on p. 22).

G. Dittmer, "Electrical Conduction and Electron Emission of Discontinuous Thin Films", Thin Solid Films, 9 1972, pp. 317–238.

*Primary Examiner*—Joseph Williams
*Assistant Examiner*—Dalei Dong
(74) *Attorney, Agent, or Firm*—Fitzpatrick, Cella, Harper & Scinto

(57) ABSTRACT

Provided is an electron-emitting device with high electron emission efficiency and with stable electron emission characteristics over a long period. The electron-emitting device has a substrate, first and second carbon films laid with a first gap in between on the surface of the substrate, and first and second electrodes electrically connected to the first carbon film and to the second carbon film, respectively. In the electron-emitting device, a narrowest gap portion between the first carbon film and the second carbon film in the first gap is located above a surface of the substrate and the substrate has a depressed portion, at least, in the first gap.

7 Claims, 20 Drawing Sheets

U.S. PATENT DOCUMENTS

| | | | | |
|---|---|---|---|---|
| 6,129,602 | A | 10/2000 | Yamanobe | 445/24 |
| 6,147,449 | A | 11/2000 | Iwasaki et al. | 313/495 |
| 6,169,356 | B1 | 1/2001 | Ohnishi et al. | 313/495 |
| 6,171,162 | B1 | 1/2001 | Iwasaki et al. | 445/6 |
| 6,179,678 | B1 | 1/2001 | Kishi et al. | 445/24 |
| 6,184,610 | B1 | 2/2001 | Shibata et al. | 313/309 |
| 6,221,426 | B1 | 4/2001 | Yamanobe | 427/77 |
| 6,231,413 | B1 | 5/2001 | Tsukamoto | 445/24 |
| 6,246,168 | B1 | 6/2001 | Kishi et al. | 313/495 |
| 6,259,191 | B1 | 7/2001 | Mitome et al. | 313/310 |
| 6,334,803 | B1 | 1/2002 | Shibata | 445/51 |
| 6,344,711 | B1 | 2/2002 | Ohnishi et al. | 313/495 |
| 6,586,872 | B2 * | 7/2003 | Shibata | 313/495 |
| 6,595,820 | B2 * | 7/2003 | Hsu et al. | 445/24 |
| 6,642,649 | B1 * | 11/2003 | Yamamoto et al. | 313/495 |
| 6,680,562 | B1 * | 1/2004 | McGinn et al. | 313/326 |

FOREIGN PATENT DOCUMENTS

| | | |
|---|---|---|
| EP | 0901144 | 3/1999 |
| EP | 0 701 265 B1 | 7/1999 |
| JP | 3-46729 | 2/1991 |
| JP | 07065703 | 3/1995 |
| JP | 7-235255 | 9/1995 |
| JP | 8-7749 | 1/1996 |
| JP | 8-102247 | 4/1996 |
| JP | 8-273523 | 10/1996 |
| JP | 8-321254 | 12/1996 |
| JP | 9-102267 | 4/1997 |
| JP | 9-120067 | 5/1997 |
| JP | 2836015 | 10/1998 |
| JP | 2903295 | 3/1999 |
| JP | 11-144605 | 5/1999 |

* cited by examiner

ELECTRON-EMITTING DEVICE, ELECTRON SOURCE USING THE ELECTRON-EMITTING DEVICES, AND IMAGE-FORMING APPARATUS USING THE ELECTRON SOURCE

This application is a division of application Ser. No. 09/442,994, filed Nov. 19, 1999, now U.S. Pat. No. 6,380, 665.

BACKGROUND OF THE INVENTION

1. Field of the Invention

The present invention relates to an electron-emitting device, an electron source using the electron-emitting devices, and an image-forming apparatus using the electron source.

2. Related Background Art

The conventionally known electron-emitting devices are roughly classified under two types of thermionic-cathode and cold-cathode.

The cold-cathode include field emission type (hereinafter referred to as "FE type") devices, metal/insulator/metal type (hereinafter referred to as "MIM type") devices, surface conduction type electron-emitting devices, and so on.

Examples of the known FE type devices include those disclosed in W. P. Dyke & W. W. Dolan, "Field emission," Advance in Electron Physics, 8, 89 (1956) or in C. A. Spindt, "Physical Properties of thin-film field emission cathodes with molybdenum cones," J. Appl. Phys., 47, 5248 (1976), and so on.

Examples of the known MIM type devices include those disclosed in C. A. Mead, "Operation of Tunnel-Emission Devices," J. Appl. Phys., 32, 646 (1961), and so on.

Examples of the surface conduction type electron-emitting devices include those disclosed in M. I. Elinson, Radio Eng. Electron Phys., 10, 1290 (1965), and so on.

The surface conduction type electron-emitting devices utilize such a phenomenon that electron emission occurs when electric current is allowed to flow in parallel to the surface in a thin film of a small area formed on a substrate. Examples of the surface conduction type electron-emitting devices reported heretofore include those using a thin film of $SnO_2$ by Elinson cited above and others, those using a thin film of Au [G. Ditmmer: "Thin Solid Films," 9, 317 (1972)], those using a thin film of $In_2O_3/SnO_2$ [M. Hartwell and C. G. Fonsted: "IEEE Trans. ED Conf.," 519, (1975)], those using a thin film of carbon [Hisashi Araki et al.: Shinku (Vacuum), Vol. 26, No. 1, p22 (1983)], and so on.

A typical device configuration of these surface conduction type electron-emitting devices is the device structure of M. Hartwell cited above, which is shown in FIG. 21. FIG. 21 is a schematic diagram. In the same drawing, numeral 1 designates an electrically insulative substrate. Numeral 4 denotes an electrically conductive, thin film, which is, for example, a thin film of a metallic oxide formed in an H-shaped pattern by sputtering and in which a linear electron-emitting region 5 is formed by energization operation called "forming" described hereinafter. In the drawing the gap L between the device electrodes is set to 0.5 to 1 mm and the width W to 0.1 mm.

In these conventional surface conduction type electron-emitting devices, it was common practice to preliminarily subject the conductive film 4 to the energization operation called the "forming", prior to execution of electron emission, thereby forming the electron-emitting region 5.

Namely, the forming is an operation for applying a dc voltage or a very slowly increasing voltage, for example at the increasing rate of about 1 V/min, to the both ends of the conductive film 4 to locally break, deform, or deteriorate the conductive film, thereby forming the electron-emitting region 5 in an electrically high resistance state. In the electron-emitting region 5 a fissure is formed in part of the conductive film 4 and electrons are emitted from near the fissure. The surface conduction type electron-emitting device experiencing the aforementioned forming operation is arranged so that electrons are emitted from the above-stated electron-emitting region 5 when the current flows in the device with application of the voltage to the above-described conductive film 4.

On the other hand, for example, as disclosed in Japanese Laid-open Patent Applications No. 07-235255, No. 08-007749, No. 08-102247, No. 08-273523, No. 09-102267, and Japanese Patent Publications No. 2836015, No. 2903295, etc., the device having experienced the forming is sometimes subjected to a treatment called an activation operation. The activation operation is a step by which significant change appears in the device current If and in the emission current Ie.

The activation step can be performed by applying a voltage to the device, as in the case of the forming operation, under an ambience containing an organic substance. This operation causes carbon or a carbon compound from the organic substance existing in the ambience to be deposited at least on the electron-emitting region of the device, so as to induce outstanding change in the device current If and in the emission current Ie, thereby achieving better electron emission characteristics.

FIG. 22 is a diagram to show a cross section of the electron-emitting device disclosed in Japanese Laid-open Patent Application No. 7-235255. In the same figure numerals 1, 4, and 5 are similar to those in FIG. 21, which are the insulating substrate, the conductive thin film, and the electron-emitting region, respectively. Numerals 2 and 3 denote the device electrodes for applying the voltage to the conductive film 4. The voltage is applied while keeping the electrode 2 at a lower potential and the electrode 3 at a higher potential. FIG. 22 shows the structure in which carbon or carbon compound 6 is deposited on the electron-emitting region 5 by execution of the aforementioned activation step, whereby the good electron emission characteristics are realized.

An image-forming apparatus can be constructed by using an electron source substrate having a plurality of such electron-emitting devices as described above and combining it with an image-forming member comprised of a fluorescent material and other members.

SUMMARY OF THE INVENTION

The image-forming apparatus such as the displays etc., however, has been and is required to have higher performance according to quick steps to multimedia society with recent increase in sophistication of information. Namely, requirements are increase in the size of screen panel, decrease in power consumption, increase in definition, enhancement of quality, decrease in space, etc. of the display devices.

With the aforementioned electron-emitting devices, there is thus a desire for the technology for keeping stable electron emission characteristics in higher efficiency and over a longer time so as to permit the image-forming apparatus with the electron-emitting devices to provide bright display images on a stable basis.

The efficiency herein means a current ratio of electric current emitted into vacuum (hereinafter referred to as emission current Ie) to electric current flowing between the electrodes (hereinafter referred to as device current If) when the voltage is applied between the pair of opposed device electrodes of the surface conduction electron-emitting device.

It is, therefore, desirable that the device current If be as small as possible, while the emission current Ie be as large as possible.

If the highly efficient electron emission characteristics can be controlled stably over a long time, we will be able to realize a bright and high-definition image-forming apparatus of low power consumption, for example a flat television, in the case of the image-forming apparatus, for example, using the fluorescent material as an image-forming member.

It is, however, the present status of the aforementioned M. Hartwell electron-emitting device that the device is not always satisfactory yet as to the stable electron emission characteristics and the electron emission efficiency and that it is very difficult to provide a high-luminance image-forming apparatus with excellent operation stability using it.

It is necessary for use in such application that sufficient emission current Ie be obtained by a practical voltage (for example, 10 V to 20 V), that the emission current Ie and device current If not vary large during driving, and that the emission current Ie and device current If not be degraded over a long time. The conventional surface conduction electron-emitting device had the following problem, however.

The electron-emitting region 5 is comprised of the gap part formed in the conductive film by the forming operation as described above, but it is not always assured that the gap is formed in the uniform width and shape throughout the entire region as shown in FIG. 21. In the case of this nonuniform shape of the electron-emitting region, the device could fail to obtain the sufficient emission current Ie, or variation and degradation will become significant in the characteristics during driving in some cases.

On the other hand, the aforementioned activation step forms a narrower gap in such a way that the carbon-containing film (carbon film) comprised of carbon or carbon compound or the like is deposited on the substrate in the gap formed in the conductive film and on the conductive film near the gap (FIG. 22). This activation step increases the emission current Ie and the device current If, but the device characteristics such as the electron emission efficiency, the lifetime, etc. are affected by the shape, the structure, the stability, etc. of the carbon-containing film (carbon film) comprised of the carbon or carbon compound deposited by the activation step.

Particularly, since a high electric field is applied to the aforementioned narrow gap part formed in the deposits, it is important to the stability to control the phenomenon possibly considered to be discharge between the deposits on the both sides of the gap.

In view of the above problem, an object of the present invention is to provide a configuration of a surface conduction electron-emitting device capable of implementing good electron emission characteristics (electron emission efficiency) and high-luminance display over a long time, an electron source using the devices, and an image-forming apparatus using it.

The present invention has been accomplished in view of the above problem and an electron-emitting device according to the present invention is an electron-emitting device comprising:

a substrate;

first and second carbon films laid with a first gap in between on a surface of the substrate; and first and second electrodes electrically connected to the first carbon film and to the second carbon film, respectively, wherein a narrowest gap portion between the first carbon film and the second carbon film in the first gap is located above the surface of the substrate, and wherein the substrate has a depressed portion, at least, in the first gap.

Another electron-emitting device according to the present invention is an electron-emitting device comprising:

a substrate;

a carbon film having a first gap on a surface of the substrate; and first and second electrodes electrically connected to the carbon film, wherein a narrowest gap portion in the first gap is located above the surface of the substrate, and wherein the substrate has a depressed portion, at least, in the first gap.

It is also preferable that the first and second carbon films have mutually different heights in a direction normal to the surface of the substrate. In this case, it is preferable to make the device emit electrons by applying a voltage in such a manner that the higher carbon film is kept at a higher potential than the lower carbon film.

The electron-emitting device of the present invention is further characterized in that the depressed portion comprises carbon.

The electron-emitting device of the present invention is also characterized in that the carbon films and the electrodes are connected via an electrically conductive, thin film placed on the surface of the substrate.

The electron-emitting device of the present invention is further characterized in that in the direction normal to the surface of the substrate the narrowest portion is located at a higher position above the surface of the substrate than the surface of the conductive, thin film.

Since the first gap further comprises a portion having the width of not more than 10 nm in the present invention, the electric field necessary for sufficient electron emission can be gained by a relatively small voltage. Particularly, when the width is 1 nm to 5 nm, the stable electron emission characteristics can be obtained while avoiding the discharge phenomenon apt to occur with application of high voltage and the short-circuit phenomenon due to deformation of the gap part likely to occur with the narrow gap.

It is also preferable that the first and second carbon films have mutually different heights in the direction normal to the surface of the substrate. In this case, it is preferable to make the device emit electrons by applying the voltage in such a manner that the higher carbon film is kept at a higher potential than the lower carbon film.

The present invention is further characterized by an electron source in which a plurality of electron-emitting devices described above are arrayed on a substrate.

The present invention is also characterized by an image-forming apparatus comprising the electron source, and an image-forming member for forming an image under irradiation of electrons emitted from the electron source.

Use of the electron-emitting device of the present invention enables to provide the electron-emitting device with high electron emission efficiency and stable electron emission characteristics over a long time.

In the electron-emitting device of the present invention, the closest portion of the opposed carbon films on the both sides of the first gap is located at the higher position than the substrate and the conductive thin film in the direction normal to the surface of the substrate. This decreases the number of electrons becoming part of the device current (If) while dropping to be absorbed on the carbon film, the conductive thin film, or the device electrode on the application side of the higher voltage during the driving of the electron-emitting device, but increases the number of electrons reaching the anode electrode (the emission current Ie). At the same time, the effective field intensity can be weakened on the surface of the substrate located in the first gap part. This allows the stable electron emission to continue over a long period.

Further, since at least the substrate exposed in the first gap part has the depressed portion, a creeping distance between the carbon films opposed on the both sides of the first gap (distance along a surface of the substrate between the carbon films opposed on the both sides of the first gap) is further increased depending upon the depth of the depressed portion. This restrains the discharge phenomenon possibly considered to be caused by the strong electric field between the carbon films opposed on the both sides of the first gap, and occurrence of excessive device current If.

As described above, the electron-emitting device and the electron source of the present invention realize the device and electron source with high efficiency and stable electron emission characteristics over a long period. The image-forming apparatus with such devices can implement the display with high efficiency and high stability over a long period.

DETAILED DESCRIPTION OF THE PREFERRED EMBODIMENTS

Preferred embodiments of the present invention will be described below.

First explained is an example of the basic structure of the electron-emitting device according to the present invention.

Figure 1A:
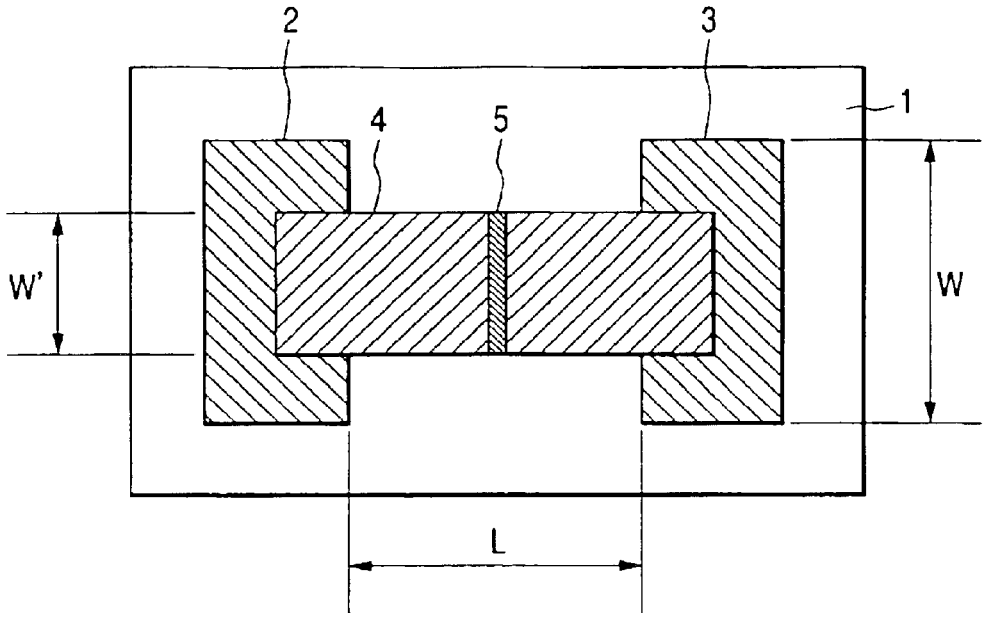
FIG. 1A and FIG. 1B are schematic diagrams of the electron-emitting device of the present invention.
Figure 1B:
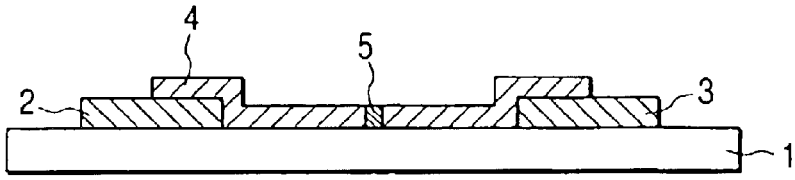
Figure 2A:
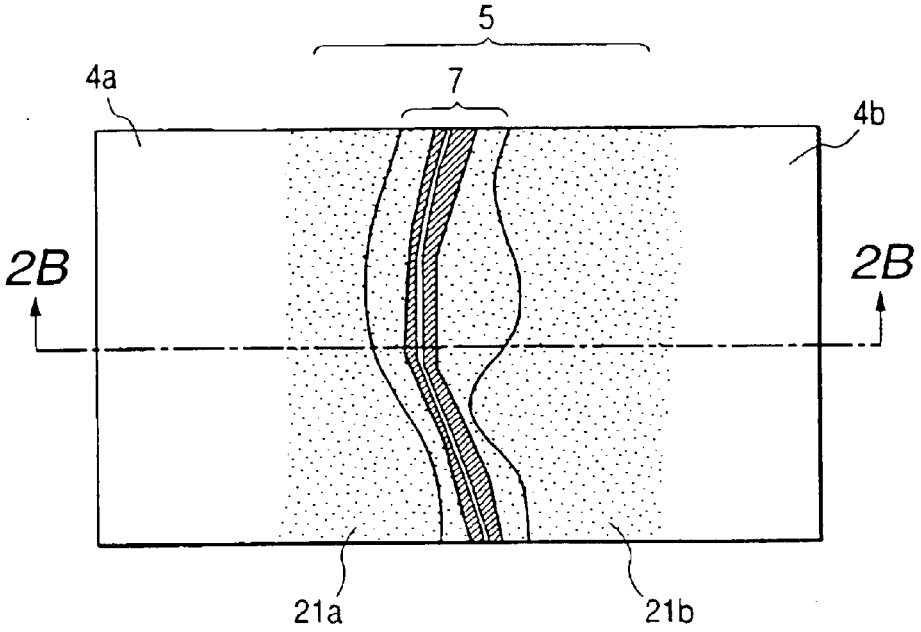
FIG. 2A and FIG. 2B are enlarged schematic diagrams of the vicinity of the electron-emitting region in the electron-emitting device of the present invention.
Figure 2B:
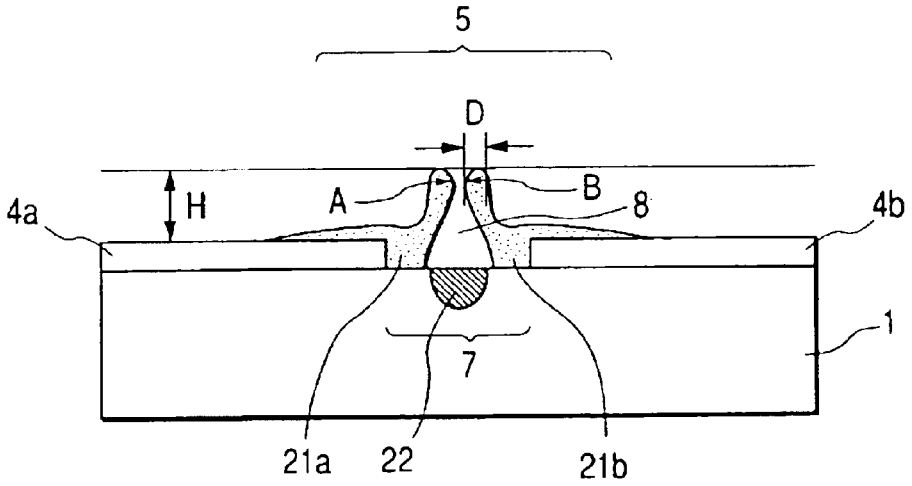
Figure 3A:
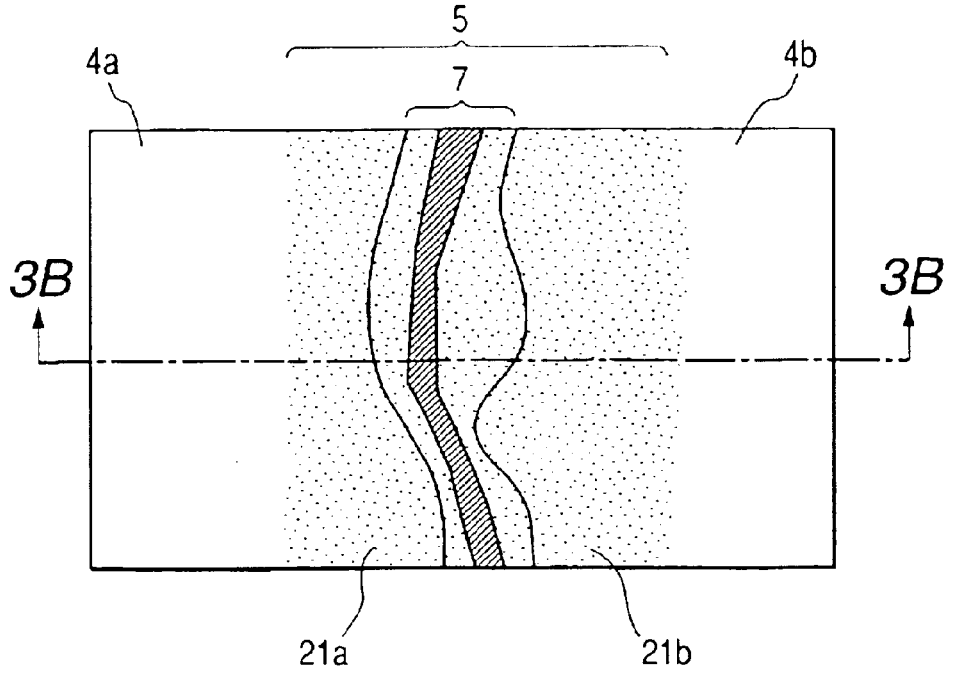
FIG. 3A and FIG. 3B are enlarged schematic diagrams of the vicinity of the electron-emitting region in the electron-emitting device of the present invention.
Figure 3B:
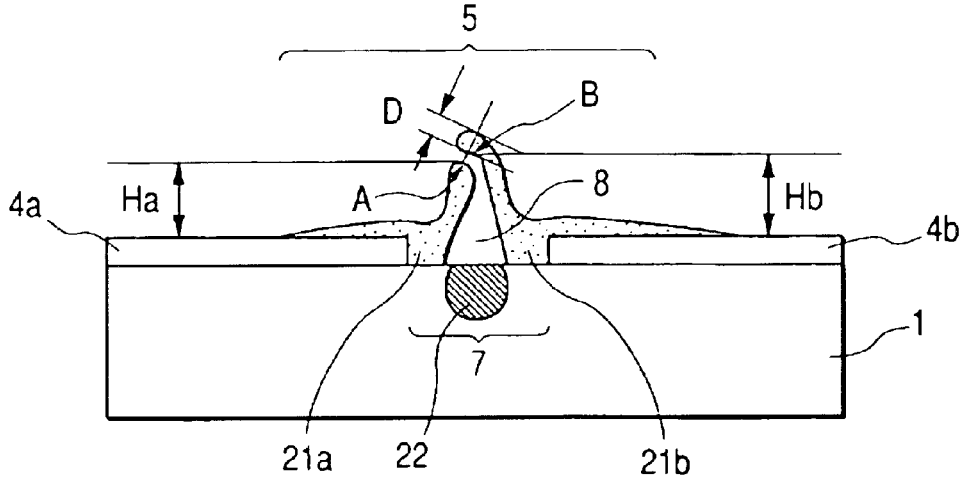

FIGS. 1A and 1B are a plan view and a sectional view, respectively, to show an example of the basic structure of a plane type electron-emitting device according to the present invention. FIG. 2A and FIG. 3A are plan views to schematically show an enlarged view of the structure in the vicinity of the electron-emitting region 5 in the surface conduction electron-emitting device illustrated in FIGS. 1A and 1B, and FIG. 2B and FIG. 3B are sectional views thereof. FIGS. 2A and 2B show an example in which a pair of carbon-containing films (carbon films) have an equal height in the direction of the normal to the surface of the substrate 1, and FIGS. 3A and 3B show an example in which the pair of carbon-containing films (carbon films) have mutually different heights in the direction of the normal to the surface of the substrate 1. The basic structure of the electron-emitting device according to the present invention will be described referring to FIGS. 1A, 1B, 2A, 2B, and 3A, 3B.

In the figures, numeral 1 designates the substrate, 2 and 3 the electrodes (device electrodes), 4, 4*a*, and 4*b* electrically conductive thin films, 5 the electron-emitting region, 21*a* and 21*b* films containing carbon (the carbon films), and 22 a substrate-deteriorated portion (the depressed portion).

The conductive thin films (4, 4*a*, 4*b*), which will be detailed hereinafter, are comprised of a pair of electrically conductive thin films opposed to each other on the both sides of second gap 7 formed by the forming operation or the like (see FIG. 7A). In the figures, the conductive films (4*a*, 4*b*) are schematically illustrated so as to be opposed in the lateral direction on the surface of the substrate and perfectly separated at the border of the second gap 7, but they may be connected in part in certain cases. Namely, a conceivable form is one in which the second gap 7 is formed in part of the conductive film 4 for electrical connection between the pair of electrodes. In other words, they are perfectly separated from each other ideally, but there occurs no inconvenience in the structure of the pair of conductive films (4*a*, 4*b*) connected to each other in a very small region, as long as sufficient electron emission characteristics are demonstrated.

On the other hand, the carbon films (21*a*, 21*b*) are laid on the substrate in the second gap 7 and on the conductive films (4*a*, 4*b*). In the figures, the carbon films (21*a*, 21*b*) are schematically illustrated so as to be opposed to each other in the lateral direction on the surface of the substrate and perfectly separated from each other at the border of the first gap 8, but there are also cases wherein they are connected in part. Namely, a conceivable form is one in which the first gap is formed in part of the carbon film for electrical connection between the pair of electrodes. In other words, they are perfectly separated from each other ideally, but there occurs no inconvenience in the structure of the pair of carbon films (21*a*, 21*b*) connected to each other in a very small region, as long as sufficient electron emission characteristics are demonstrated.

In the above structure, the carbon films (21*a*, 21*b*) are electrically connected to the respective electrodes (2, 3). In the figures the carbon film (21*a* or 21*b*) is connected via the conductive film (4*a* or 4*b*) to the electrode (2 or 3). It is, however, possible to deposit the carbon films (21*a*, 21*b*) over the respective electrodes (2, 3) as well so as to be electrically connected directly to the electrodes, depending upon the distance between the device electrodes (L) and the activation conditions described hereinafter. Further, it is also possible to employ the structure in which the carbon films (21*a*, 21*b*) are directly connected to the electrodes 2, 3, without use of the conductive film 4. The present invention does not always necessitate the conductive film 4. The point is that, at least, the carbon films (21*a*, 21*b*) and the electrodes (2, 3) laid on the surface of the substrate are electrically connected to each other.

Since the conductive films (4*a*, 4*b*), which will be detailed hereinafter, are very thin films, they are apt to suffer thermal structural change, such as cohesion or the like, and composition change due to heat or the like during the production process or during the driving. In the present invention, therefore, when the conductive films are used, the surfaces of the conductive films are covered by the above carbon films (21*a*, 21*b*). It is then preferable to restrain variation in the device characteristics due to the thermal structural change etc. of the conductive films, particularly, by covering all the surfaces of the conductive films located between the electrodes 2, 3.

When the conductive films are not used, the region between the device electrodes corresponds to the second gap described above. In the electron-emitting device of the present invention, the carbon films (21*a*, 21*b*) are placed on the surface of the substrate for placement and support of the device.

The substrate 1 is one selected from glass substrates including those of quartz glass, soda lime glass, a glass substrate in which $SiO_2$ is deposited on soda lime glass or the like by sputtering or the like, and so on. It is thus desirable to use a material containing $SiO_2$ for the substrate in the present invention. The use of the substrate containing $SiO_2$ enables to form the electron-emitting region 5 with the substrate-deteriorated (depressed) portion 22 by the activation step described hereinafter.

A material for the opposed device electrodes 2, 3 can be any material that has the electrically conductive nature, but the material can be selected, for example, from metals such as Ni, Cr, Au, Mo, W, Pt, Ti, Al, Cu, or Pd, or alloys thereof; print conductors comprised of a metal or a metallic oxide such as Pd, Ag, Au, $RuO_2$, or Pd—Ag, and glass, etc.; transparent, conductive materials such as $In_2O_3$—$SnO_2$; semiconductive/conductive materials such as polysilicon; and so on.

The device electrode gap L, the length W of the device electrodes, and the shape thereof are properly designed according to an application form of the electron-emitting device etc. For example, in the case of a display device for television or the like described hereinafter, the pixel size is designed corresponding to the image size. Particularly, a high-definition television monitors necessitate small pixel size and high definition. In order to achieve sufficient luminance in the limited size of the electron-emitting devices, they are designed so as to obtain sufficient emission current Ie.

The device electrode gap L is in the range of several ten nm to several hundred $\mu$m, and is set according to the photolithography technology being the basis of the production method of device electrodes, i.e., the performance of exposure apparatus, an etching method, etc., and the voltage applied between the device electrodes. The gap L is preferably in the range of several $\mu$m to several ten $\mu$m.

The device electrode length W and the thickness d of the device electrodes 2, 3 are properly designed depending upon the resistance of the electrodes, the connection to wiring, and the matter concerning placement of the electron source with many electron-emitting devices provided; normally, the length W of the device electrodes is in the range of several $\mu$m to several hundred $\mu$m and the thickness d of the device electrodes is in the range of several nm to several $\mu$m.

In addition to the structure shown in FIG. 1A and FIG. 1B, the device can also be constructed in another structure in which the conductive film 4 and the device electrodes (2, 3) are stacked in the named order on the substrate 1.

The conductive film 4 is preferably a fine particle film comprised of fine particles in order to achieve the good electron emission characteristics. The thickness of the film 4 is properly set taking account of step coverage over the device electrodes 2, 3, the resistance between the device electrodes 2, 3, the forming conditions described hereinafter, and so on.

Since the magnitude of the device current If and the emission current Ie depends upon the width W' of the conductive film 4, the conductive film is designed so as to obtain the sufficient emission current in the limited size of the electron-emitting device, as in the case of the shape of the device electrodes described above.

Thermal stability of the conductive film 4 may dominate the lifetime of the electron emission characteristics and, therefore, a material having a higher melting point is desirably used as a material for the conductive film 4. However, the higher the melting point of the conductive film 4, the more power the energization forming described hereinafter necessitates, normally.

Further, depending upon the form of the resultant electron-emitting region, there could arise a problem in the electron emission characteristics, for example, such as increase in the applied voltage enough for electron emission (threshold voltage) or the like, in some cases.

The present invention does not require a material having a particularly high melting point as a material for the conductive film 4, and permits us to select a material and a form capable of forming a good electron-emitting region by relatively low forming power.

Examples of preferred materials satisfying the above conditions are electroconductive materials such as Ni, Au, PdO, Pd, Pt, and so on having such a thickness that Rs (sheet resistance) is in the range of $10^2$ to $10^7$ Ω/□. Rs is a value appearing in an equation of R=Rs (l/w) where the resistance R is measured in the longitudinal direction of a thin film having the thickness t, the width w, and the length 1, and thus Rs=ρ/t where ρ is the resistivity. The thickness to indicate the above resistance is in the range of approximately 5 nm to 50 nm. In this thickness range, the thin film of each material preferably has the form of fine particle film.

The fine particle film stated herein is a film as an assemblage of plural fine particles and the microstructure thereof is a state in which the fine particles are dispersed separately or a state in which the fine particles are adjacent to each other or overlapping each other (including a state in which some fine particles gather to form the island-shaped structure as a whole).

The grain sizes of the fine particles are in the range of several Å to several hundred nm, and are preferably in the range of 1 nm to 20 nm.

Further, among the materials exemplified above, PdO is a suitable material, because a thin film of PdO can be formed readily by baking an organic Pd compound in the atmosphere, because it is a semiconductor having a relatively low electric conductivity and a wide process margin of thickness for obtaining the resistance Rs in the aforementioned range, because the film resistance can be lowered by readily reducing it to the metal Pd after formation of the gap 7 in the conductive film 4, and so on. It is, however, noted that the effect of the present invention can also be achieved by the other materials without having to be limited to PdO nor to the above exemplified materials.

The length of the electron-emitting region 5 is almost determined by the width W' of the conductive film 4.

The electron-emitting region 5 is comprised of the carbon-containing films (carbon films) 21*a*, 21*b* opposed to each other on either side of the first gap 8 narrower than the second gap 7 formed in the conductive film 4, and the substrate-deteriorated portion (depressed portion) 22 (FIGS. 2A, 2B and FIGS. 3A, 3B).

The carbon films 21*a*, 21*b* are mainly made of graphite-like carbon and may contain an element as a component of the conductive film 4 (4*a*, 4*b*).

A feature of the present invention is that the first gap 8 separating the carbon films 21*a*, 21*b* has a narrower portion above the surface of the substrate and above the surface of the conductive film in the direction of the normal (perpendicular) to the surface of the substrate.

Another feature of the present invention is that the surface of the substrate is depressed at the position of the first gap.

The carbon films (21*a*, 21*b*) in the present invention are characterized by the height H or the heights Ha, Hb from the surface of the conductive film (4*a*, 4*b*), and the thickness D of the carbon film 21*b* on the higher potential side where a higher potential is applied during the driving (FIGS. 2A, 2B and FIGS. 3A, 3B). Although the above heights H, Ha, Hb are defined as those from the surface of the conductive film herein, they may be regarded as heights from the surface of the substrate without any substantial trouble, because the conductive films are the very thin films.

In FIG. 2B the height H is indicated as a distance between the top point of the carbon films 21*a*, 21*b* and the surface of the conductive film for convenience' sake, but, more precisely, the heights H and Ha, Hb, are defined as heights from the surface of the conductive film (or the surface of the substrate) at a position of the strongest electric field (point A and point B in the figure) when a potential difference is given between the carbon films 21*a* and 21*b* so as to keep the carbon film 21*b* at the higher potential. The thickness D is defined as a thickness (length) of the carbon film present at the position where the carbon film 21*b* on the higher potential side is cut by an extension line connecting the above point A to point B.

In a broad sense, the above position of the strongest electric field (point A and point B) is the position where the carbon films 21*a* and 21*b* are closest to each other (where the distance of the gap 8 is the narrowest). Then the gap between the above point A and point B is preferably not more than 10 nm and more preferably in the range of 1 nm to 5 nm. The details will be described hereinafter, but the voltage (Vf) necessary for the sufficient electron emission can be relatively small voltage when the gap between above point A and point B is set to not more than 10 nm. Further, when the gap between the above point A and point B is set in the range of 1 nm to 5 nm, it becomes possible to avoid the discharge phenomenon apt to occur with application of high voltage and the short-circuit phenomenon due to deformation of the gap part likely to occur with the narrow gap, thus achieving the stable electron emission characteristics.

Further, in the present invention the above points A and B where the strongest electric field described above is applied are apart from the surface of the substrate, and thus the distance between the carbon films 21*a* and 21*b* at the position of contact with the surface of substrate can be greater than the distance between the above points A and B. This means that the effective intensity of the electric field applied to the surface of the substrate in contact with the carbon films 21*a* and 21*b* can be weakened without weakening the effective intensity of the electric field at the position (point A and point B) contributing to the emission of electron. For the above reason, the electron-emitting device of the present invention can restrain the discharge phenomenon at the surface of the substrate located in the first gap and can maintain the stable electron emission characteristics over a long period.

For describing the electron-emitting device of the present invention in further detail, a measurement-evaluation system will be described first referring to FIG. 4.

Figure 4:
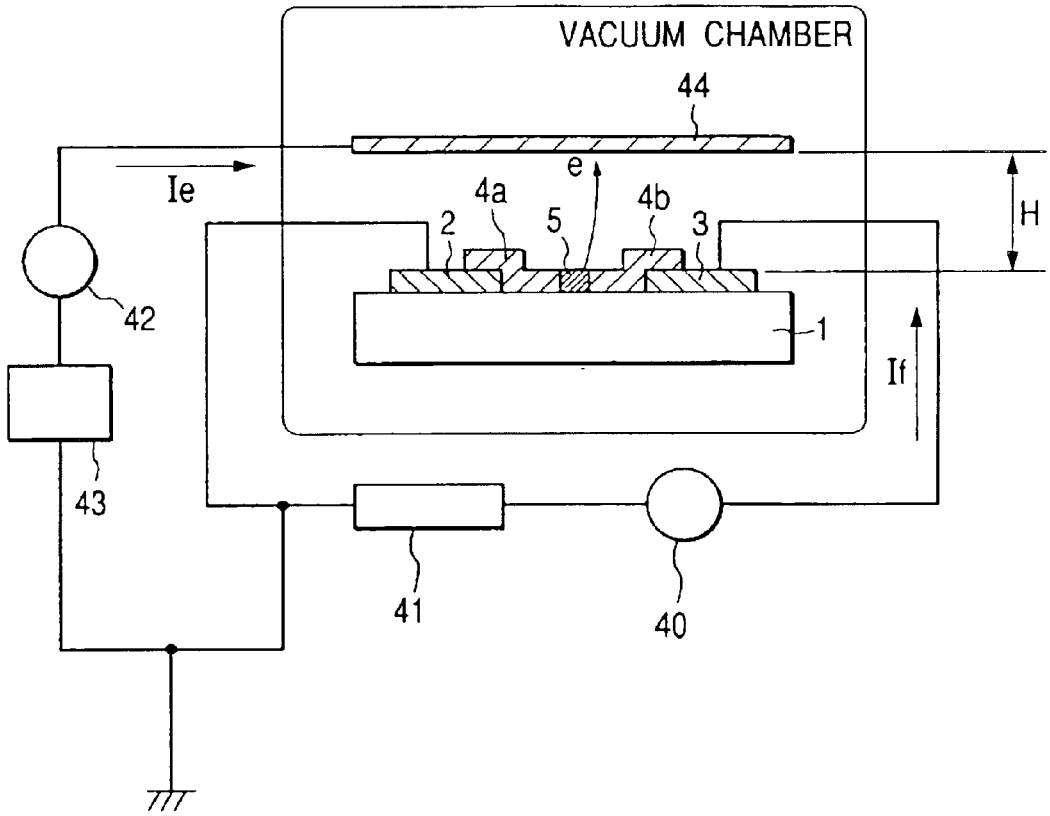
FIG. 4 is a schematic diagram to show an example of a vacuum process system provided with measurement-evaluation function.

FIG. 4 is a schematic, structural drawing of the measurement-evaluation system for measuring the electron emission characteristics of the device having the structure shown in FIGS. 1A, 1B to FIGS. 3A, 3B. In FIG. 4, numeral 1 represents the substrate, 2 and 3 the device electrodes, 4 the conductive films, and 5 the electron-emitting region.

Numeral 41 indicates a power supply for applying the device voltage Vf to the device, 40 a current meter for measuring the device current If flowing in the conductive films 4 between the device electrodes 2, 3, 44 an anode electrode for capturing the emission current Ie emitted from the electron-emitting region of the device, 43 a high-voltage supply for applying the voltage to the anode electrode 44, and 42 a current meter for measuring the emission current Ie emitted from the electron-emitting region 5 of the device.

For measuring the above device current If and emission current Ie of the electron-emitting device, the power supply 41 and ammeter 40 are connected to the device electrodes 2, 3, and the anode electrode 64 to which the power supply 43 and ammeter 42 are connected is located above the electron-emitting device. The electron-emitting device and anode electrode 44 are set in a vacuum chamber.

In FIG. 4, when the voltage (Vf) is applied between the device electrodes 2, 3 so as to keep the device electrode 3 at a higher potential, a potential difference is created according to the voltage applied between the carbon film 21*a* and the carbon film 21*b*, illustrated in FIGS. 2A, 2B or FIGS. 3A, 3B, through the conductive films 4. At this time the strong electric field is generated around the point A on the carbon film 21*a* and around the point B on the carbon film 21*b*, as described above. When this electric field is high enough to cause tunneling of electrons from the carbon film 21*a* to the carbon film 21*b*, the electrons are considered to tunnel from the vicinity of the point A on the carbon film 21*a* toward the vicinity of the point B on the carbon film 21*b*.

Here the electric field enough for the sufficient tunneling is approximately $5\times10^9$ V/m in the case of the ordinary carbon materials (with the work functions of 4.5 to 5.0 eV), though it depends upon the work function of the carbon film. The number of tunneling electrons becomes extremely small with electric fields smaller than it, whereas electric field deformation of the carbon films 21 will become likely to occur at electric fields greater than it.

However, if the applied voltage (Vf) is increased, the creeping discharge (surface discharge) phenomenon will become easier to occur on the surface of the substrate around the electron-emitting region. Particularly, at the voltage over 50 V, the damage to the device due to the above discharge becomes unignorable. Therefore, the distance between the carbon films 21*a* and 21*b* is preferably not more than 10 nm in order to drive the device at the voltage of not more than 50 V. When further consideration is given to instability of electron emission due to a rise of potential at the surface of the substrate around the electron-emitting region, the applied voltage is preferably not more than about 25 V and the gap is, therefore, more preferably not more than 5 nm.

On the other hand, when the distance between the above points A and B is not more than 1 nm, tunneling will not occur virtually by the applied voltage below the work function. Thus the applied voltage needs to be not less than 5 V, so that the electric field not less than $5\times10^9$ V/m is applied to the gap. In this case, the field deformation of the carbon films 21 becomes easier to occur as described above, and a short of the gap becomes easier to occur, in conjunction with the narrower gap. This can result in generating wasteful ohmic current and causing breakage of the electron-emitting region by rush current.

For the above reasons, the width of the first gap 8 (the distance between the above points A and B) is preferably not more than 10 nm and most preferably in the range of 1 to 5 nm.

If the portions of the above carbon films 21*a*, 21*b* at the narrowest gap were located at the position of contact with the substrate 1 or at the position closer to the substrate 1 than the thickness of the conductive films 4, it would be considered that the electrons tunneling from the vicinity of the point A are scattered in part in the vicinity of the point B of the carbon film 21*b* and the rest electrons penetrate the carbon film 21*b* to flow further to the conductive film 4*b* and device electrode 3 to be measured as the device current If by the ammeter 40.

It is, however, considered that in the present invention part of the penetrating electrons pass through the carbon film 21*b* to be emitted into the vacuum, because the carbon film 21*b* is formed in the small thickness D.

It is also assumed that some of the electrons partly scattered in the vicinity of the point B of the carbon film 21*b* go again into the conductive film 4*b* to become part of the device current If and that the other electrons fly in the vacuum to be captured by the anode electrode 44 to be measured as the emission current Ie.

The transmittance Te of the electrons penetrating the carbon film 21*b* can be expressed by Eq. (1) below.

$$Te=\exp(-D/La) \qquad \text{Eq (1)}$$

In this equation La is an attenuation length of electrons in the carbon film 21*b*.

It is known that the attenuation length in substance (metal) of electrons with the energy of 10 eV to 20 eV is approximately three to ten atomic layers. Accordingly, for example, where the d002 face spacing of carbon forming the carbon film 21*b* is 0.38 nm and the direction of incidence of electrons agrees with the c-axis of carbon, the attenuation length of electron is about 1 to 4 nm.

Supposing that the transmittance Te of electrons penetrating the carbon film 21*b* is, for example, 0.1%, D=28 nm by putting Te=0.001 and La=4 into Eq. (1).

In the present invention, when the transmittance Te of electrons penetrating the carbon film 21*b* is set to 0.1%, that is, when the thickness D of the carbon film 21*b* is set to approximately the above value, the great effect can be accomplished in increase of the electron emission efficiency, as compared with the conventional electron-emitting devices.

It is known in practice that the attenuation length La of electron becomes longer than the above value where the density of electrons in the substance is small (in the case of semiconductors and insulating materials). Since the above thickness D varies depending upon the orientation of graphite-like carbon forming the carbon film 21*b*, the face spacing thereof, and the carrier density, it is not limited precisely to this value. The thickness D is preferably not more than 100 nm and more preferably not more than 30 nm. The smaller the value of D, the greater the effect of transmission of electron. However, if the thickness is too small the resistance will be higher at the elevated portion of the carbon film 21*b* than at the other portions, and a sufficient electric field will not be applied between the above points A and B. Further, because some thickness is necessary for keeping the structural strength, the above thickness D is preferably at least one tenth of the height H of the carbon film 21*b* and more preferably not less than 10 nm.

Further, it is also considered that some of electrons having penetrated the carbon film 21*b* also go again into the conductive film 4*b*, as the scattered electrons did, and the other electrons fly in the vacuum to be captured by the anode electrode 44 and measured as the emission current Ie. It is thus preferable, particularly, to determine the relation of the heights of the carbon films 21*a*, 21*b* so as to satisfy the following condition as indicated in FIG. 3B.

$$Hb>Ha \quad (2)$$

When the carbon films are formed in this relation and when the voltage is applied so as to keep the higher carbon film 21*b* at a higher potential, the electrons having passed through the carbon film 21*b* are emitted with an upward component (or a component directed toward the anode electrode 44) from the surface of the conductive film 4*b*. This can decrease the rate of electrons penetrating into the conductive film 4*b*, whereby the stable electron emission characteristics can be accomplished with better efficiency.

In the present invention, further, the deteriorated portion (the depressed portion) is positioned in the surface of the substrate at the position of the above first gap 8. When the depressed portion is formed in the surface of the substrate at the position of the first gap 8 in this way, the creeping distance can be increased further between the carbon films 21*a* and 21*b* in contact with the surface of the substrate. As a consequence, it can further restrain the aforementioned creeping discharge (surface discharge) phenomenon on the surface of the substrate, due to the application of the strong electric field to the very narrow first gap 8.

In the present invention, it is further preferable that carbon be placed on the surface of the above depressed portion. The depressed portion is located substantially at the center of the electron-emitting region. Therefore, the surface of the depressed portion will be always subjected to irradiation of electrons. When carbon is laid on the surface of the depressed portion, charging can be restrained on the surface of the depressed portion of the substrate accordingly. As a result, the creeping discharge phenomenon can be restrained further on the surface of the substrate and stabler electron emission characteristics can be achieved.

Since the pair of carbon-containing films (carbon films) 21*a*, 21*b* and the substrate are formed in the shape as described above in the present invention, the stable electron emission characteristics can be obtained with excellent efficiency over a long period.

There are various conceivable methods as production methods of the electron-emitting device of the present invention described above and an example thereof will be described referring to FIGS. 5A to 5C and FIGS. 7A to 7D. The production method of the present invention will be described in order referring to FIGS. 1A, 1B, FIGS. 2A, 2B, FIGS. 5A to 5C, and FIGS. 7A to 7D.

Figure 5A:
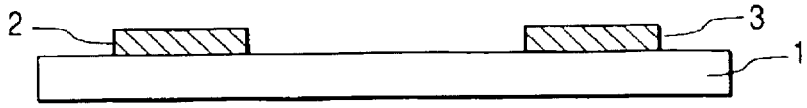
FIG. 5A, FIG. 5B, and FIG. 5C are schematic diagrams to show some of production steps of the electron-emitting device of the present invention.

1) The substrate 1 is cleaned well with a detergent, pure water, and an organic solvent. Thereafter, the material of device electrodes is deposited by vacuum evaporation, sputtering, or the like and then the device electrodes 2, 3 are formed by photolithography (FIG. 5A).

In the case wherein the carbon-containing film (carbon film) 21 is placed in connection with the electrodes 2, 3 without use of the conductive film 4 as described previously, the gap between the electrodes 2, 3 can be set, for example, by use of the FIB process or the like to approximately the second gap 7 formed in the forming step described hereinafter. In that case, the following steps 2) and 3) can be omitted. It is thus noted that the conductive film 4 is not always necessary in the present invention. Namely, a necessary condition is that, at least, the carbon films (21*a*, 21*b*) and the electrodes (2, 3) are electrically connected. When the device is constructed in the structure without the conductive film 4 in this way, the aforementioned second gap 7 corresponds to the gap (L) between the electrodes (2, 3). It is, however, preferable to use the above conductive film 4 in order to produce the device of the present invention at low cost.

Figure 5B:
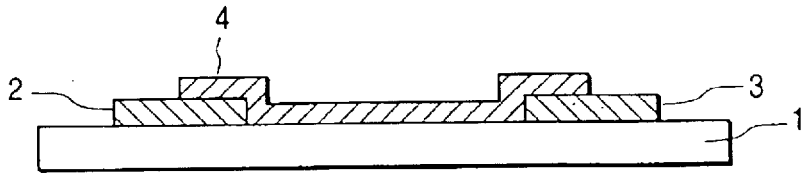

2) Between the device electrode 2 and the device electrode 3 provided on the substrate 1, an organometallic solution is applied and dried to form an organometallic film. The organometallic solution is a solution of an organometallic compound containing the principal element of the metal such as Pd, Ni, Au, Pt or the like of the conductive film material. After this, the organometallic film is burned and patterned by lift-off, etching, or the like, thereby forming the conductive film 4 (FIG. 5B). The method of forming the conductive film 4 was described by the method of applying the organometallic solution herein, but, without having to be limited to this, the conductive film 4 may also be formed by vacuum evaporation, sputtering, CVD, dispersion application, dipping, a spinner method, an ink-jet method, and so on in some cases.

Figure 5C:
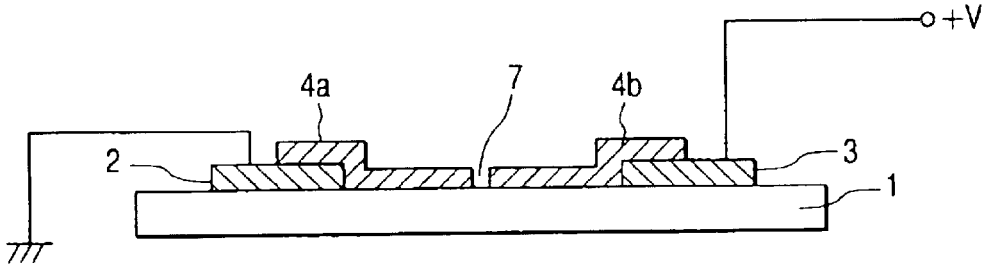

3) Then the energization operation called the "forming" is carried out by applying the pulsed voltage or increasing voltage from an unillustrated power supply between the device electrodes 2, 3, whereupon the second gap 7 is created in part of the conductive film 4 and the conductive films 4*a*, 4*b* are opposed to each other in the lateral direction on the surface of the substrate and on the both sides of the gap 7 (FIG. 5C). The second gap 7 may also be connected in part in some cases.

Electrical processing operations after the forming operation are carried out, for example, in the measurement-evaluation system described above and illustrated in FIG. 4.

The measurement-evaluation system illustrated in FIG. 4 is the vacuum chamber, and the vacuum chamber is equipped with devices necessary for the vacuum chamber, including an evacuation pump, a vacuum meter, etc., though not illustrated, so as to be able to measure and evaluate the electron-emitting device under a desired vacuum. The evacuation pump is comprised of a high vacuum system such as a magnetic levitation turbo-pump, a dry pump, or the like not using oil, and an ultra-high vacuum system such as an ion pump or the like. A gas introducing device not illustrated is attached to this measurement system, whereby vapor of desired organic substance can be introduced under desired pressure into the vacuum chamber. The entire vacuum chamber and the electron-emitting device can be heated by a heater not illustrated.

The forming operation is carried out by a method for applying pulses whose pulse peak values are a constant voltage or by a method for applying voltage pulses with increasing pulse peak values. First, FIG. 6A illustrates the voltage waveform where pulses with the pulse peak values of the constant voltage are applied.

Figure 6A:
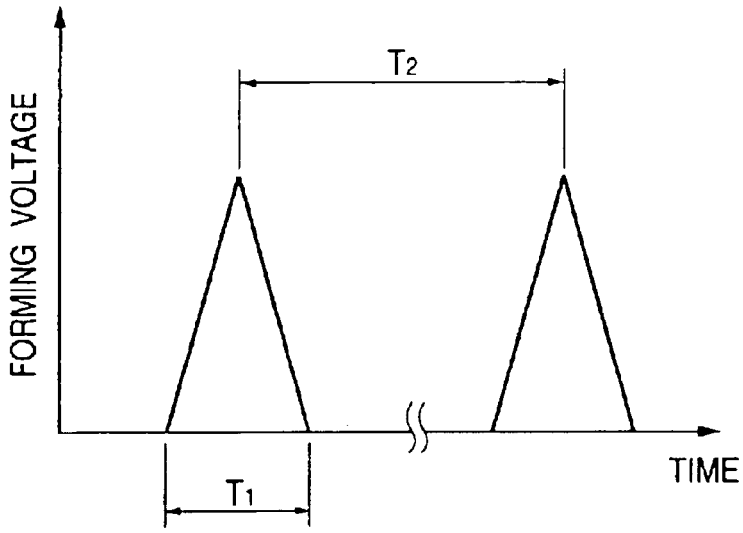
FIG. 6A and FIG. 6B are schematic diagrams to show examples of voltage waveforms which can be used in the forming step as a part of the production steps of the electron-emitting device of the present invention.

In FIG. 6A, T1 and T2 indicate the pulse width and pulse spacing of the voltage waveform, T1 being 1 μsec to 10 msec and T2 being 10 μsec to 100 msec, and the peak value of the triangular waves (the peak voltage upon the forming) is properly selected as occasion may demand.

Figure 6B:
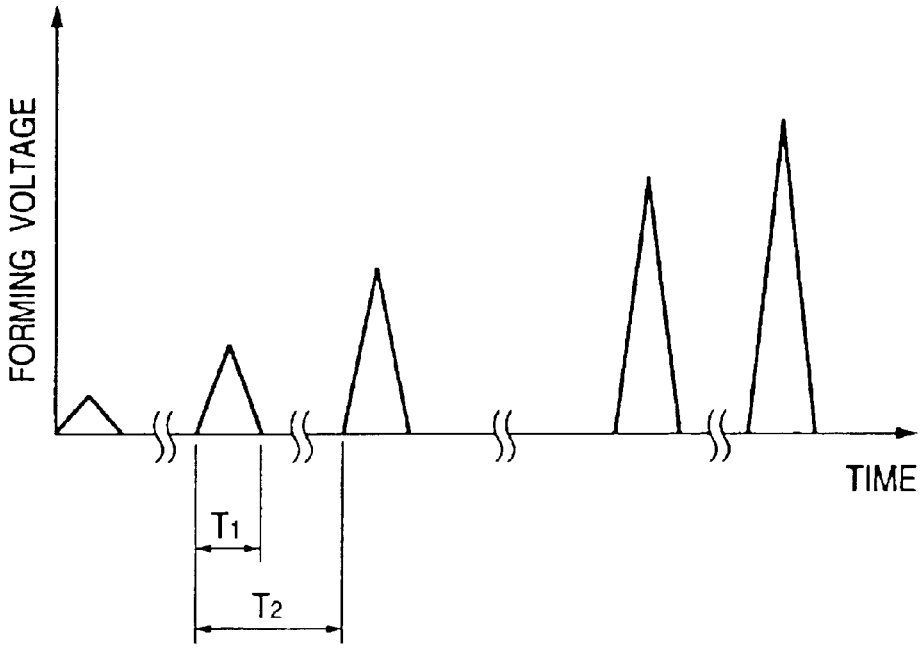

Next, FIG. 6B shows the voltage waveform where the voltage pulses are applied with increasing pulse peak values.

In FIG. 6B, T1 and T2 indicate the pulse width and pulse spacing of the voltage waveform, T1 being 1 μsec to 10 msec and T2 being 10 μsec to 100 msec, and the peak values of the triangular waves (the peak voltages upon the forming) are increased, for example, in steps of about 0.1 V.

The end of the forming operation is determined as follows. A voltage so low as not to locally break or deform the conductive film 4, for example the pulse voltage of about 0.1 V, is placed between the forming pulses to measure the device current, and the resistance is calculated. For example, when the resistance is not less than a value 1,000 times as great as the resistance before the forming processing, the forming is ended.

On the occasion of forming the gap 7 as described above, the forming operation is carried out by applying the triangular pulses between the electrodes of the device, but the waves applied between the electrodes of the device do not have to be limited to the triangular waves, and may be any other waves such as rectangular waves. In addition, the peak value, the pulse width, the pulse spacing, etc. of the waves are not limited to the above-stated values, either, but appropriate values can be selected according to the resistance etc. of the electron-emitting device so as to form the gap 7 well.

4) Then the activation operation is effected on the device after completion of the forming operation. The activation operation is performed by introducing gas of organic substance into the vacuum chamber illustrated in FIG. 4 and applying the voltage between the electrodes of the device under an atmosphere containing organic molecules. This operation causes the carbon-containing film (carbon film) to be deposited on the device from the organic substance present in the atmosphere, also causing deterioration of the substrate. This results in remarkable change in the device current If and the emission current Ie.

In the present invention the shape of the carbon films formed by the activation operation need to be formed under good control, as illustrated in FIGS. 2A, 2B or FIGS. 3A, 3B. The shape of the carbon films is influenced by the waveform of the voltage applied to the device, the pressure of the organic substance introduced, the diffusion mobility on the surface of the device, the average residence time on the surface of the device, and so on. Another important factor is easiness of handling such as easiness of introduction into the vacuum chamber, easiness of exhaust after the activation, and so on. A variety of organic compounds have been checked from the above viewpoints and it was found out that good controllability was resulted, particularly, with use of tolunitrile (cyanotoluene) or acrylonitrile.

The process of forming the carbon films in the activation operation will be described below referring to FIGS. 7A to 7D, FIGS. 8A, 8B, and FIG. 9. In FIGS. 7A to 7D, numeral 1 designates the substrate, 2 and 3 the device electrodes, 4*a* and 4*b* the conductive, thin films, 7 the second gap between the conductive, thin films (4*a*, 4*b*), 21*a* and 21*b* the carbon films, and 22 the substrate-deteriorated portion (depressed portion).

Figure 8A:
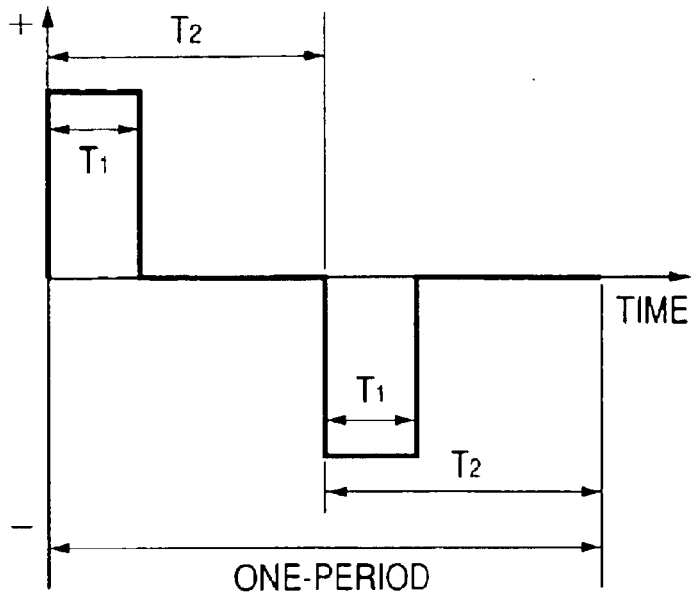
FIG. 8A and FIG. 8B are schematic diagrams to show examples of voltage waveforms which can be used in the activation step as a part of the production steps of the electron-emitting device of the present invention.
Figure 8B:
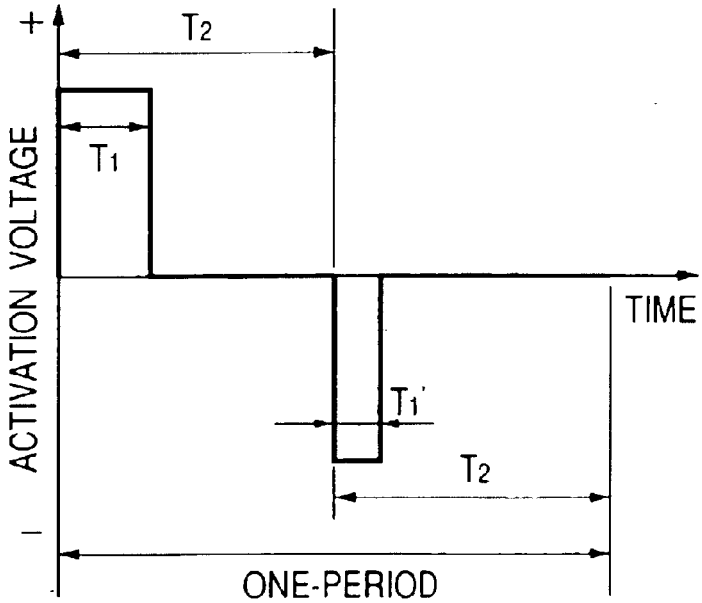

FIG. 8A and FIG. 8B show examples of the voltage applied to the device electrodes during the activation operation, which can be suitably applicable to the present invention. The maximum voltage applied is properly selected in the range of 10 to 20 V. In FIG. 8A, T1 denotes the width of positive and negative pulses in the voltage waveform, T2 the pulse spacing, and the voltage values are so set that the absolute values of the positive and negative pulses are equal to each other. In FIG. 8B, T1 and T1' represent widths of the positive and negative pulses, respectively, in the voltage waveform, T2 the pulse spacing, T1>T1', and the voltage values are so set that the absolute values of the positive and negative pulses are equal to each other.

Figure 7A:
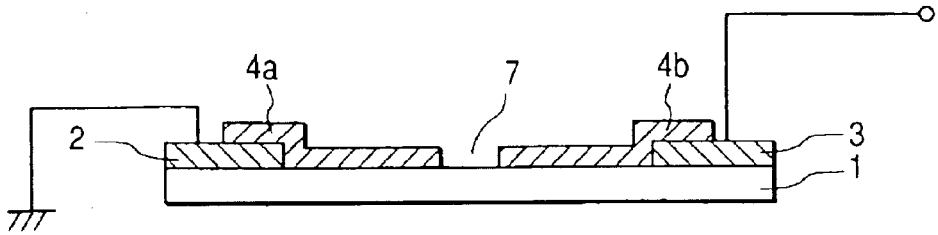
FIG. 7A, FIG. 7B, FIG. 7C, and FIG. 7D are schematic diagrams to show the activation step which is a part of the production steps of the electron-emitting device of the present invention.

FIG. 7A is a diagram to schematically show the vicinity of the electron-emitting region of the electron-emitting device before the activation operation. The device is placed in the vacuum chamber which was evacuated once to the pressure of the order of $10^{-6}$ Pa. Thereafter, the gas of tolunitrile or acrylonitrile was introduced into the chamber (FIG. 4). The preferred pressure of tolunitrile introduced is slightly affected by the shape of the vacuum chamber, the members used in the vacuum chamber, etc., but it is approximately in the range of $1\times10^{-5}$ Pa to $1\times10^{-3}$ Pa. Under the pressure below $1\times10^{-5}$ Pa, rates of activation will be considerably low and there will be cases wherein the activation does not take place well, depending upon the composition or partial pressure of the other gas remaining. On the other hand, under the pressure over $1\times10^{-3}$ Pa, rates of activation will be extremely high and it will become difficult to form the desired shape of deposits with good repeatability. The preferred range of partial pressure of introduced gas differs depending upon saturated vapor pressure of the organic substance at the temperature thereof, and in the case of acrylonitrile it is approximately in the range of $1\times10^{-3}$ Pa to $1\times10^{-1}$ Pa.

Figure 7B:
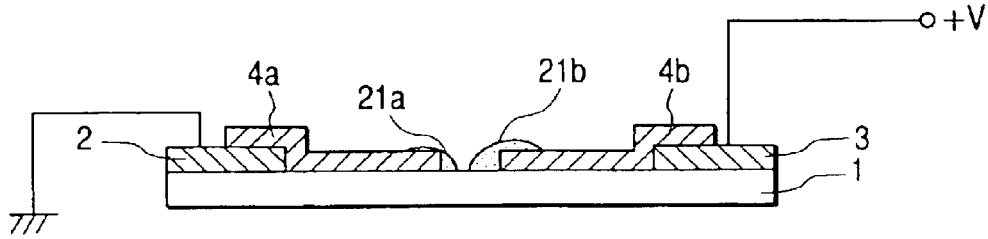

In the activation step the voltage illustrated in FIG. 8A or 8B is placed between the device electrodes 2, 3. This initiates deposition of the carbon film, into the second gap 7 and onto the conductive films 4*a*, 4*b* in the vicinity thereof (FIG. 7B). In this step the carbon films 21*a*, 21*b* are also deposited simultaneously in the direction normal to the plane of the drawing.

Figure 7C:
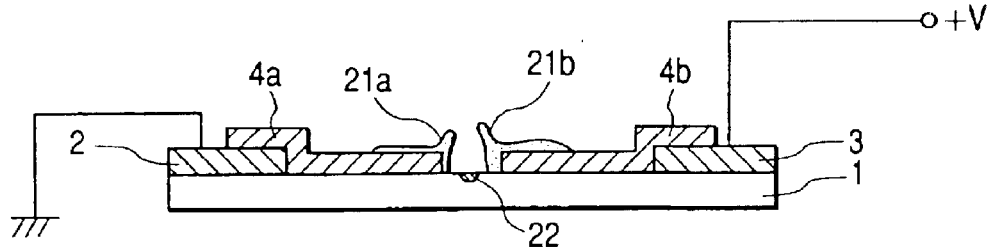
Figure 7D:
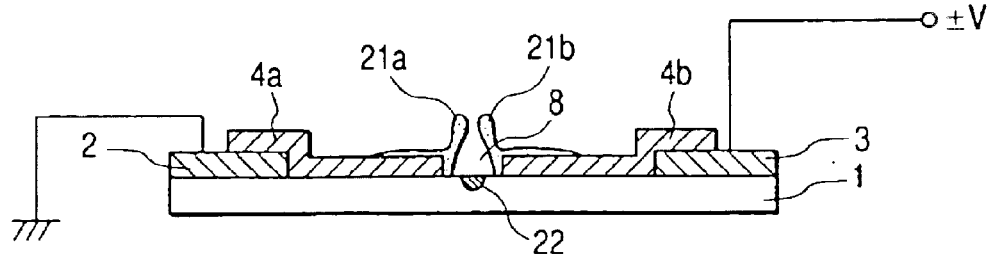

As the activation operation continues further, the formation of carbon films advances more so as to grow upward from the surface of the conductive films, accompanied by deterioration of the substrate (the depression described hereinafter) (FIG. 7C). When the form illustrated in FIG. 7D is resulted finally, the activation operation is terminated.

Figure 9:
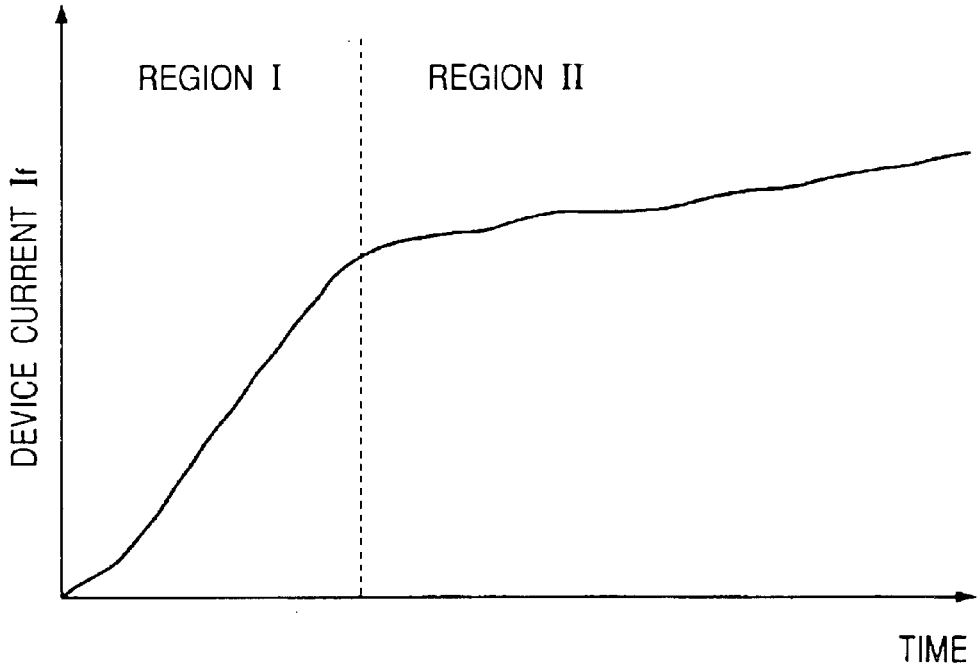
FIG. 9 is a schematic diagram to show change of the device current If during the activation step.

FIG. 9 shows variation in the current (device current If) flowing between the device electrodes 2, 3 during the above activation step.

FIGS. 7A and 7B show states of the forming process of the carbon films in region I in FIG. 9. FIGS. 7C and 7D show states of deposition of the carbon-containing films in region II.

In region II where the increase of the device current is gentle, the operation develops the depression of the substrate as deterioration of the substrate and the formation of the carbon films 21*a*, 21*b* upward from the surface of the substrate. When the termination of the activation step is determined while measuring the device current, the activation step should be terminated after entrance into the above region II is confirmed, accordingly.

The carbon films 21*a*, 21*b* having their heights from the surface of the substrate approximately equal to each other, as illustrated in FIG. 2B and FIG. 7D, can be formed by applying the voltage of the waveform as illustrated in FIG. 8A.

Since the quality of carbon forming the carbon films 21*a*, 21*b* can be approximately equalized by carrying out the step of applying the bipolar potentials with the equal pulse width and pulse height during the activation step in this way, it becomes possible to restrain prior deterioration or extinction of either one of the carbon films 21*a*, 21*b* exposed to high temperature during the driving of the electron-emitting device, and in turn make the electron emission characteristics stabler.

On the other hand, when the voltage as illustrated in FIG. 8B is applied with the potential of the device electrode 3 being positive during the activation step, the carbon films can be made in asymmetric structure in which the carbon film 21*b* electrically connected to the device electrode 3 is higher than the carbon film 21*a* from the surface of the substrate, as illustrated in FIG. 3B.

The following is our consideration on the deterioration (depression) of the substrate.

Si is consumed as the temperature increases under the condition in which $SiO_2$ (the material of the substrate) exists near carbon.

$$SiO_2+C\rightarrow SiO\uparrow+CO\uparrow$$

It is considered that as such reaction takes place, Si in the substrate is consumed and the substrate comes to have the bored (depressed) shape.

Figure 23:
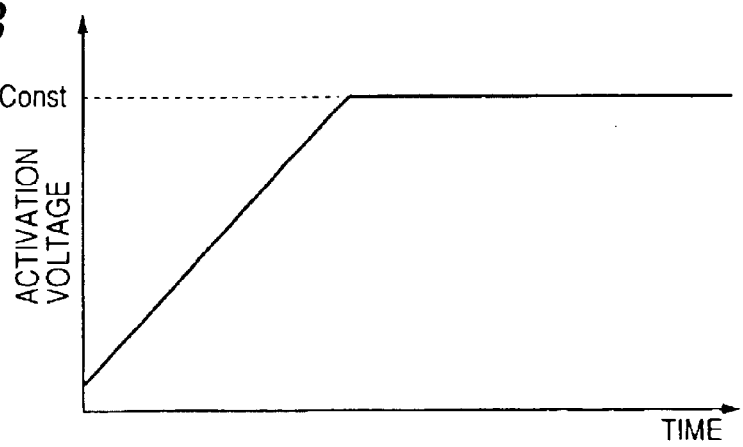
FIG. 23 is a schematic diagram of applied voltage preferably used in the activation step of the present invention.

For further placing carbon on the depressed portion 22, it is preferable to apply the dc-like voltage illustrated in FIG. 23, instead of the voltage waveforms illustrated in FIGS. 8A and 8B. As illustrated in FIG. 23, it is preferable that the voltage applied first in the activation step be lower than the maximum voltage applied in the activation step but higher than the forming voltage described previously. When the voltage illustrated in FIG. 8 is applied only to the device electrode 3 so as to keep the device electrode 3 positive during the activation step illustrated in FIGS. 7A to 7D, the carbon films can be formed in the asymmetric structure in which the height of the carbon film 21*b* is higher from the surface of the substrate than the carbon film 21*a*, as illustrated in FIG. 3B. On the other hand, in order to equalize the heights of the carbon films 21*a*, 21*b* from the surface of the substrate as illustrated in FIG. 7D, the voltage of the waveform illustrated in FIG. 23 is applied once so as to keep the potential of the device electrode 3 positive and thereafter the voltage is applied conversely so as to keep the potential of the device electrode 3 negative. When the step of applying the polarity-inverted potentials is carried out during the activation step in this way, the quality of carbon forming the carbon films 21*a*, 21*b* can be approximately equalized, which can restrain the prior deterioration or extinction of either one of the carbon films 21*a*, 21*b* exposed to high temperature during the driving of the electron-emitting device and in turn make the electron emission characteristics stabler. The process of growth of the carbon films in the application of the dc-like voltage as illustrated in FIG. 23 is basically similar to that illustrated in FIGS. 7A to 7D. If the end of the activation step is determined while measuring the device current on the occasion of formation of the carbon films by applying the voltage of the waveform illustrated in FIG. 23, after the voltage applied to the device electrodes during the activation goes into the region of constant voltage (the const voltage of FIG. 23), it is confirmed that the device current is in the above region II of FIG. 9 and then the activation step is terminated.

Next described is the carbon of the carbon films 21*a*, 21*b* as the carbon-containing films in the present invention.

The graphite-like carbon in the present invention involves carbon of the perfect graphite crystal structure (so called HOPG), carbon of slightly disordered crystal structure having the crystal grains of about 20 nm (PG), carbon of more disordered crystal structure having the crystal grains of about 2 nm (GC), and non-crystalline carbon (which means amorphous carbon and a mixture of amorphous carbon with microcrystals of the graphite). This means that carbon even with disordered layers of grain boundaries between graphite grains or the like can be used favorably.

5) The electron-emitting device thus produced is then subjected preferably to the stabilization step. This step is a step of exhausting the organic substance from the vacuum vessel. It is desirable to eliminate the organic substance out of the vacuum vessel, and the partial pressure of the organic substance is preferably not more than 1 to $3\times10^{-8}$ Pa. The pressure of the gas including the other gases (total pressure) is preferably not more than 1 to $3\times10^{-6}$ Pa and particularly preferably not more than $1\times10^{-7}$ Pa. The evacuation unit for evacuating the vacuum vessel is one not using oil in order to prevent the oil generated from the unit from affecting the characteristics of the device. Specifically, the evacuation unit can be selected, for example, from an absorption pump, an ion pump, and so on. During the evacuation of the inside of the vacuum vessel, the whole vacuum vessel is heated to facilitate the exhaust of the organic molecules adsorbing to the inner wall of the vacuum vessel and to the electron-emitting device. The heating at this time is carried out at 150 to 350° C., and desirably for as long time as possible, preferably at 200° C. or more, but, without having to be limited to these conditions, the conditions are properly selected depending upon various factors including the size and shape of the vacuum vessel, the placement of the electron-emitting device, and so on.

The ambience during the driving after completion of the stabilization step is preferably that upon the end of the above stabilization step, but, without having to be limited to this, sufficiently stable characteristics can be maintained even with some increase of the pressure per se as long as the organic substance is adequately removed.

The employment of the vacuum ambience as described can suppress new deposition of carbon or the carbon compound and thus maintain the shape of the carbon-containing films (carbon films) of the present invention, so that the device current If and emission current Ie are stabilized.

The fundamental characteristics of the electron-emitting device according to the present invention, which was fabricated as described above, will be described referring to FIG. 4 and FIG. 10.

Figure 10:
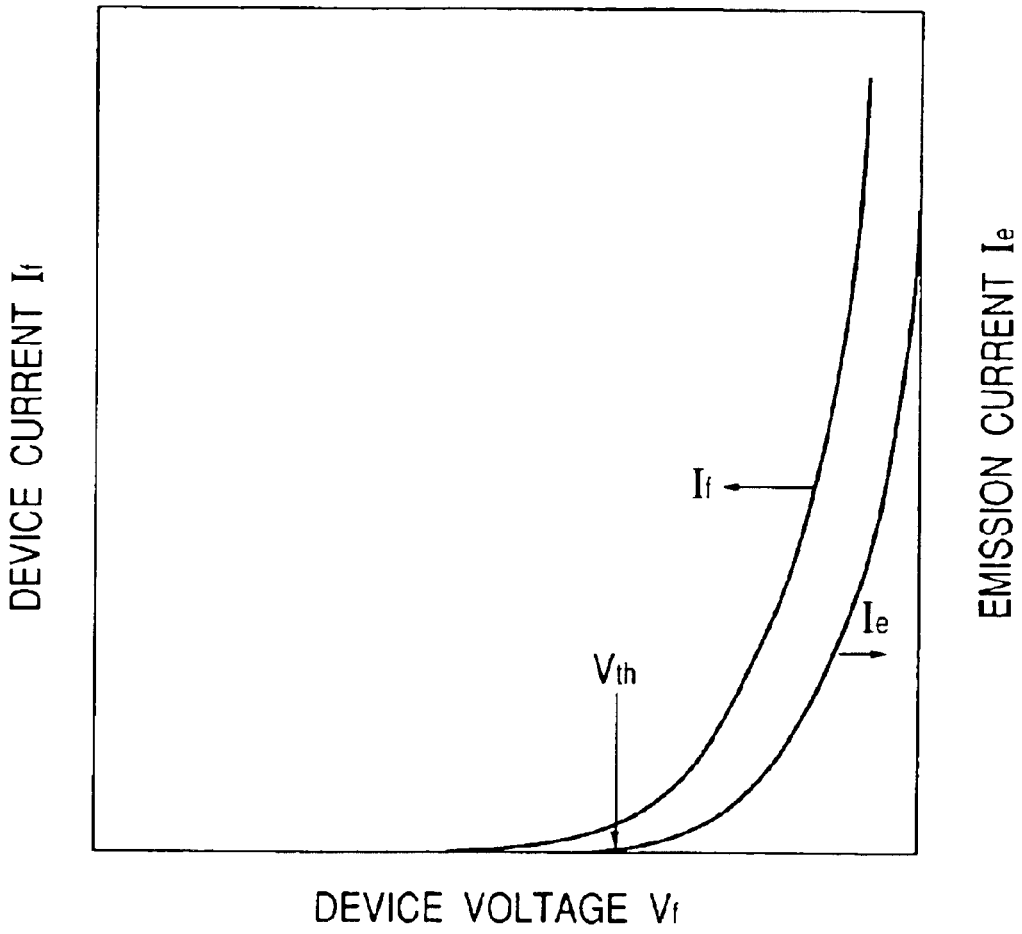
FIG. 10 is a schematic diagram to show the relation among the emission current Ie, the device current If, and the device voltage Vf of the electron-emitting device of the present invention.

FIG. 10 shows a typical example of the relation of the emission current Ie and device current If to the device voltage Vf of the device after the stabilization operation, measured by the measurement-evaluation system shown in FIG. 4. FIG. 10 is illustrated in arbitrary units, because the emission current Ie is extremely smaller than the device current If. As apparent from FIG. 10, the present electron-emitting device has three properties as to the emission current Ie.

First, the present device shows a sudden increase of the emission current Ie with application of the device voltage over a certain voltage (which will be called a threshold voltage, Vth in FIG. 10) and little emission current Ie is detected with application of the device voltage smaller than the threshold voltage Vth. Namely, the device is a nonlinear device having the definite threshold voltage Vth to the emission current Ie.

Second, the emission current Ie is dependent on the device voltage Vf, so that the emission current Ie can be controlled by the device voltage Vf.

Third, the emission charge captured by the anode electrode 44 is dependent on the period of application of the device voltage Vf. Namely, an amount of the charge captured by the anode electrode 44 can be controlled by the period of application of the device voltage Vf.

The electron emission characteristics can be controlled readily according to the input signal by using the characteristics of the electron-emitting device as described above. Further, since the electron-emitting device according to the present invention has the stable and high-luminance electron emission characteristics, it is expected to be applied in many fields.

Examples of application of the electron-emitting device of the present invention will be described below.

For example, the electron source or the image-forming apparatus can be constructed by arraying a plurality of electron-emitting devices according to the present invention on the substrate.

The array of devices on the substrate can be arranged, for example, according to either one of the following array configurations. An array configuration (called a ladder type) is such that a lot of electron-emitting devices are arranged in parallel, many rows are arrayed of the electron-emitting devices in a certain direction (called a row direction), the both ends of the individual devices being connected to wires in each row, and electrons are controlled by a control electrode (called a grid) disposed in a space above the electron source in the direction perpendicular to the wires (called a column direction). Another array configuration is such that n Y-directional wires are placed through an interlayer insulation layer above m X-directional wires described hereinafter and an X-directional wire and a Y-directional wire are connected to a pair of device electrodes of each surface conduction electron-emitting device. This will be referred to hereinafter as a simple (passive) matrix configuration.

This simple matrix configuration will be described below in detail.

According to the aforementioned features of the three fundamental properties of the surface conduction electron-emitting device according to the present invention, the electrons emitted from the surface conduction electron-emitting device can be controlled by the peak value and the width of the pulsed voltage applied between the opposed device electrodes in the range over the threshold voltage. On the other hand, few electrons are emitted with the voltage below the threshold voltage. This property permits the surface conduction electron-emitting devices to be selected according to the input signal, so as to control amounts of electrons emitted therefrom, by properly applying the above pulsed voltage to the individual devices even in the configuration of the many electron-emitting devices arrayed.

Figure 11:
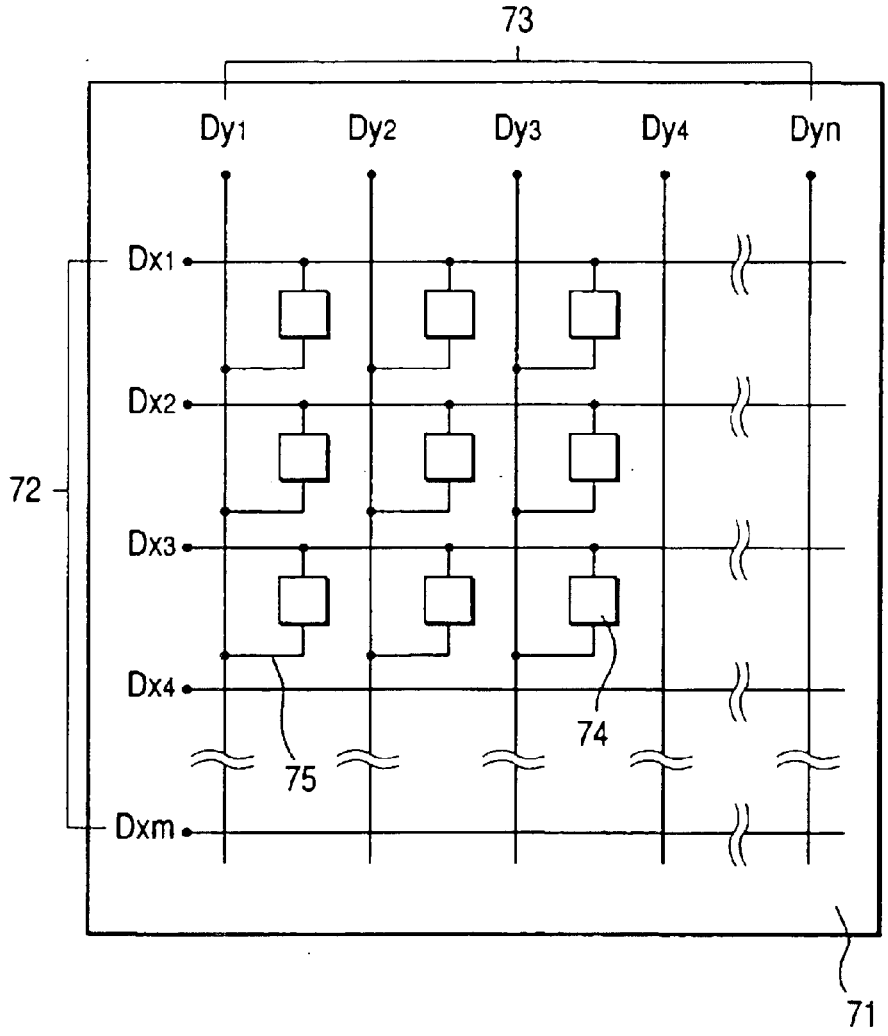
FIG. 11 is a schematic diagram to show an example of application to the electron source in which the electron-emitting devices of the present invention are arrayed in a passive matrix configuration.

The structure of an electron source substrate constructed based on this principle will be described below referring to FIG. 11.

The m X-directional wires 72 are comprised of Dx1, Dx2, . . . , Dxm, which are made of an electroconductive metal or the like in a desired pattern on the insulating substrate 71 by vacuum evaporation, printing, sputtering, or the like. The material, thickness, and width of the wires, etc. are so designed as to supply almost uniform voltage to the many surface conduction electron-emitting devices. The Y-directional wires 73 are comprised of n wires of Dy1, Dy2, . . . , Dyn and are made of the conductive metal or the like in the desired pattern by the vacuum evacuation, printing, sputtering, or the like, as the X-directional wires 72 are. The material, thickness, and width of the wires are so designed as to supply almost uniform voltage to the many surface conduction electron-emitting devices. An interlayer insulation layer not illustrated is placed between these m X-directional wires 72 and n Y-directional wires 73 to establish electrical insulation between them, thus composing the matrix wiring (where m and n both are positive integers).

The interlayer insulation layer not illustrated is $SiO_2$ or the like formed by vacuum evaporation, printing, sputtering, or the like, which is made in a desired pattern over the entire surface or in part of the insulating substrate 71 on which the X-directional wires 72 are formed. Particularly, the thickness, material, and production method thereof are properly set so as to endure the potential difference at intersections between the X-directional wires 72 and the Y-directional wires 73. The X-directional wires 72 and Y-directional wires 73 are routed out each as an external terminal.

Further, the opposed device electrodes (not illustrated) of the surface conduction electron-emitting devices 74 are electrically connected to the m X-directional wires 72 (Dx1, Dx2, . . . , Dxm) and to the n Y-directional wires 73 (Dy1, Dy2, . . . , Dyn) by connection lines 75 of a conductive metal or the like made by vacuum evaporation, printing, sputtering, or the like, in the same manner as described previously.

Here some or all of the component elements may be common to or different among the conductive metals of the m X-directional wires 72, n Y-directional wires 73, connection lines 75, and opposed device electrodes. These materials are properly selected, for example, from the materials from the aforementioned materials for the device electrodes.

Although the details will be described hereinafter, an unillustrated scanning signal applying means for applying a scanning signal for scanning of the rows of the surface conduction electron-emitting devices 74 arrayed in the X-direction according to the input signal is electrically connected to the X-directional wires 72, while an unillustrated modulation signal generating means for applying a modulation signal for modulating each column of the surface conduction electron-emitting devices 74 arrayed in the Y-direction according to the input signal is electrically connected to the Y-directional wires 73.

The driving voltage applied to each of the surface conduction electron-emitting devices is supplied as a difference voltage between the scanning signal and the modulation signal applied to the device.

Figure 12:
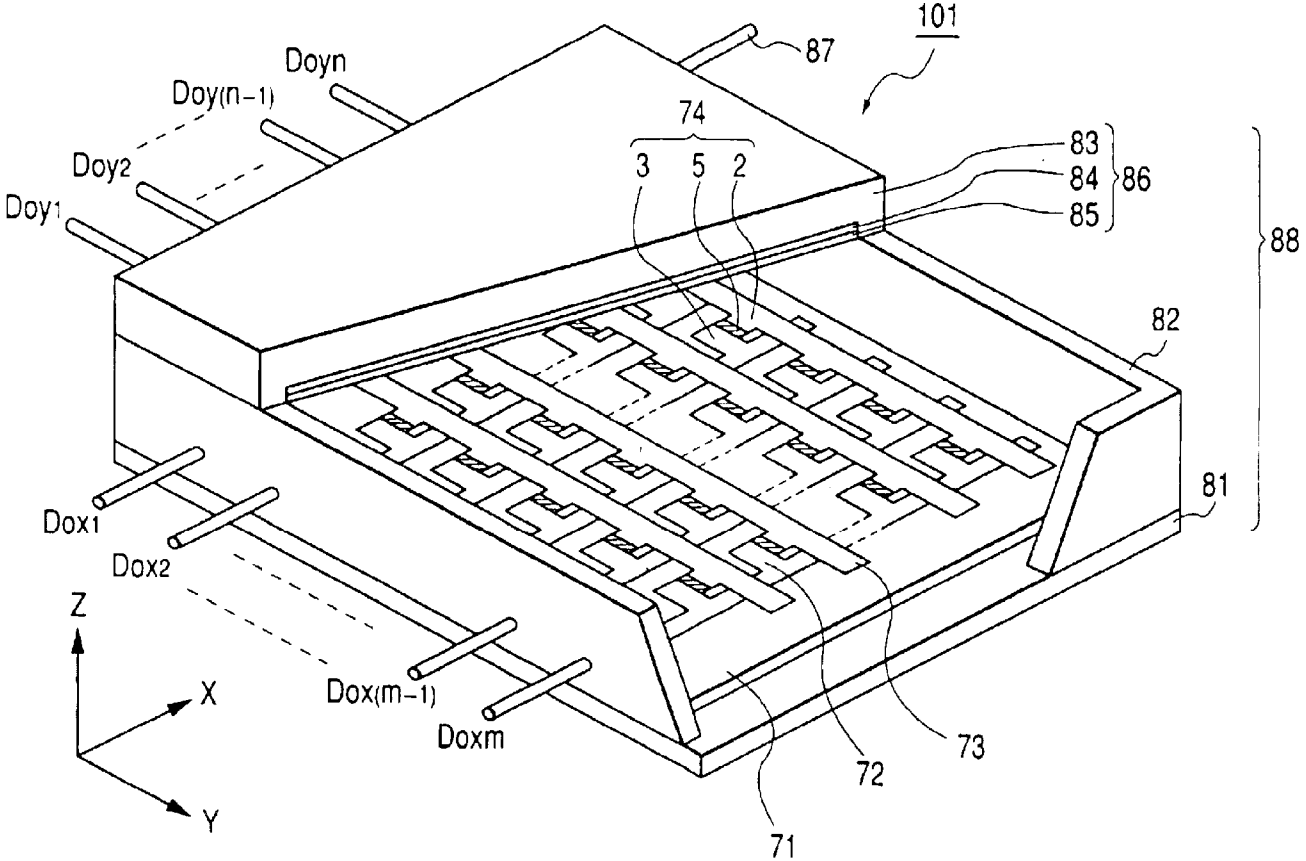
FIG. 12 is a schematic diagram to show an example of application in which the electron-emitting devices of the present invention are applied to the image-forming apparatus.
Figure 13A:
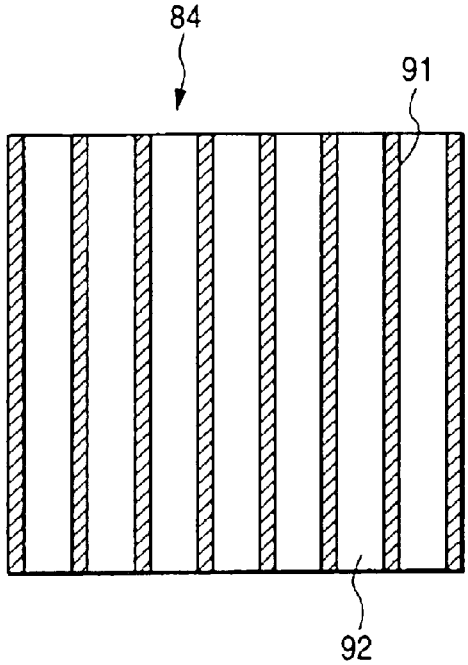
FIG. 13A and FIG. 13B are schematic diagrams to show examples of fluorescent films.
Figure 13B:
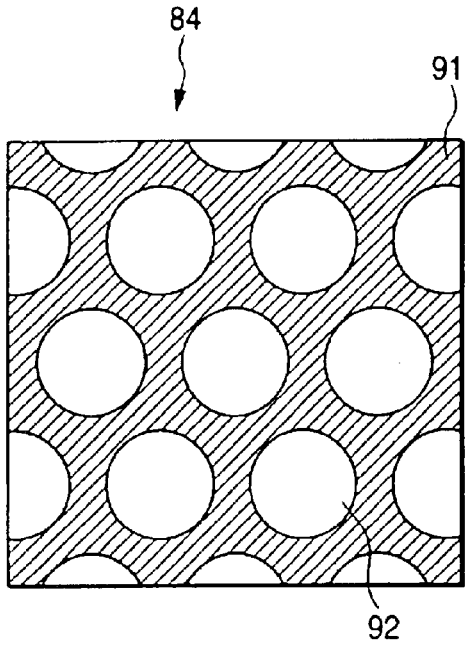

Next described referring to FIG. 12 and FIGS. 13A and 13B is an example of the electron source using the electron source substrate of the simple matrix configuration as described above, and the image-forming apparatus used for display or the like. FIG. 12 is a diagram to show the fundamental structure of the image-forming apparatus and FIGS. 13A and 13B illustrate fluorescent films.

In FIG. 12, numeral 71 represents the electron source substrate in which a plurality of electron-emitting devices are arrayed, 81 a rear plate to which the electron source substrate 71 is fixed, and 86 a face plate in which a fluorescent film 84, a metal back 85, etc. are formed on an internal surface of glass substrate 83. Numeral 82 indicates a support frame, and the rear plate 81, support frame 82, and face plate 86 are coated with frit glass and baked at 400 to 500° C. in the atmosphere or in nitrogen for ten or more minutes, so as to seal them, thereby composing an envelope 88.

In FIG. 12, numeral 74 denotes devices corresponding to the surface conduction electron-emitting devices shown in FIGS. 1A, 1B, FIGS. 2A, 2B or FIGS. 3A, 3B. Numerals 72 and 73 denote the X-directional wires and Y-directional wires connected to the pairs of device electrodes of the surface conduction electron-emitting devices. If the wires to these device electrodes are made of the same wiring material as the device electrodes, they are also called the device electrodes in some cases.

The envelope 88 is comprised of the face plate 86, the support frame 82, and the rear plate 81 as described above, but, because the rear plate 81 is provided mainly for the purpose of reinforcing the strength of the substrate 71, the separate rear plate 81 can be omitted if the substrate 71 itself has sufficient strength. In that case, the support frame 82 may be bonded directly to the substrate 71, whereby the envelope 88 can be constructed of the face plate 86, the support frame 82, and the substrate 71.

As another example, the envelope 88 can also be constructed with sufficient strength against the atmospheric pressure by mounting an unrepresented support called a spacer between the face plate 86 and the rear plate 81.

FIGS. 13A and 13B illustrate fluorescent films. The fluorescent film 84 is constructed of only a fluorescent material in the monochrome case. In the case of a color fluorescent film, the fluorescent film is constructed of fluorescent materials 92 and a black conductive material 91 called black stripes (FIG. 13A) or a black matrix (FIG. 13B) depending upon the array of the fluorescent materials. Purposes of provision of the black stripes or the black matrix are to make color mixture or the like unobstructive by blacking portions between the fluorescent materials 92 of the three primary colors necessitated in the case of the color display, and to suppress decrease in contrast due to reflection of ambient light on the fluorescent film 84. A material for the black conductive material 91 can be selected from materials including the principal component of graphite commonly widely used, and, without having to be limited thereto, also from any electrically conductive materials with little transmission and little reflection of light.

A method for applying the fluorescent materials to the glass substrate 83 is selected from a precipitation method, printing, and the like, in either the monochrome or the color case.

The metal back 85 is normally provided on the inner surface of the fluorescent film 84. Purposes of the metal back are to enhance the luminance by specular reflection of light traveling to the inside out of the light emitted from the fluorescent materials, toward the face plate 86, to use the metal back as an electrode for applying the electron beam acceleration voltage, to protect the fluorescent material from damage due to collision of negative ions generated in the envelope, and so on. The metal back can be fabricated after production of the fluorescent film by carrying out a smoothing operation (normally called filming) of the inside surface of the fluorescent film and thereafter depositing Al by vacuum evaporation or the like.

The face plate 86 may be provided with a transparent electrode (not illustrated) on the outer surface side of the fluorescent film 84 in order to enhance the electrically conductive property of the fluorescent film 84.

On the occasion of carrying out the aforementioned sealing, sufficient position alignment is necessary in the color case in order to match the electron-emitting devices with the respective color fluorescent materials.

The envelope 88 is sealed after evacuated to the vacuum degree of about $1.3\times10^{-5}$ Pa through an unrepresented exhaust pipe. In certain cases a getter operation is also carried out in order to maintain the vacuum degree after the sealing of the envelope 88. This getter operation is an operation for heating a getter (not illustrated) placed at a predetermined position in the envelope 88 by a heating method such as resistance heating or high-frequency heating to form an evaporated film, immediately before or after execution of the sealing of the envelope 88. The getter normally contains a principal component of Ba or the like, and maintains, for example, the vacuum degree of $1.3\times10^{-3}$ to $1.3\times10^{-5}$ Pa by adsorption action of the evaporated film.

In the image displaying apparatus of the present invention completed as described above, the voltage is applied to each electron-emitting device through the terminals outside the container, Dox1 to Doxm and Doy1 to Doyn, to make the device emit electrons, a high voltage of not less than several kV is applied to the metal back 85 or to the transparent electrode (not illustrated) through a high-voltage terminal 87 to accelerate electron beams, and the electron beams are guided onto the fluorescent film 84 to bring about excitation and luminescence thereof, thereby displaying an image.

It should be noted that the structure described above is the schematic structure necessary for the fabrication of the suitable image-forming apparatus used for display or the like and that the details, for example such as the material for each member, can be properly selected so as to suit application of the image-forming apparatus, without having to be limited to the contents described above.

Figure 14:
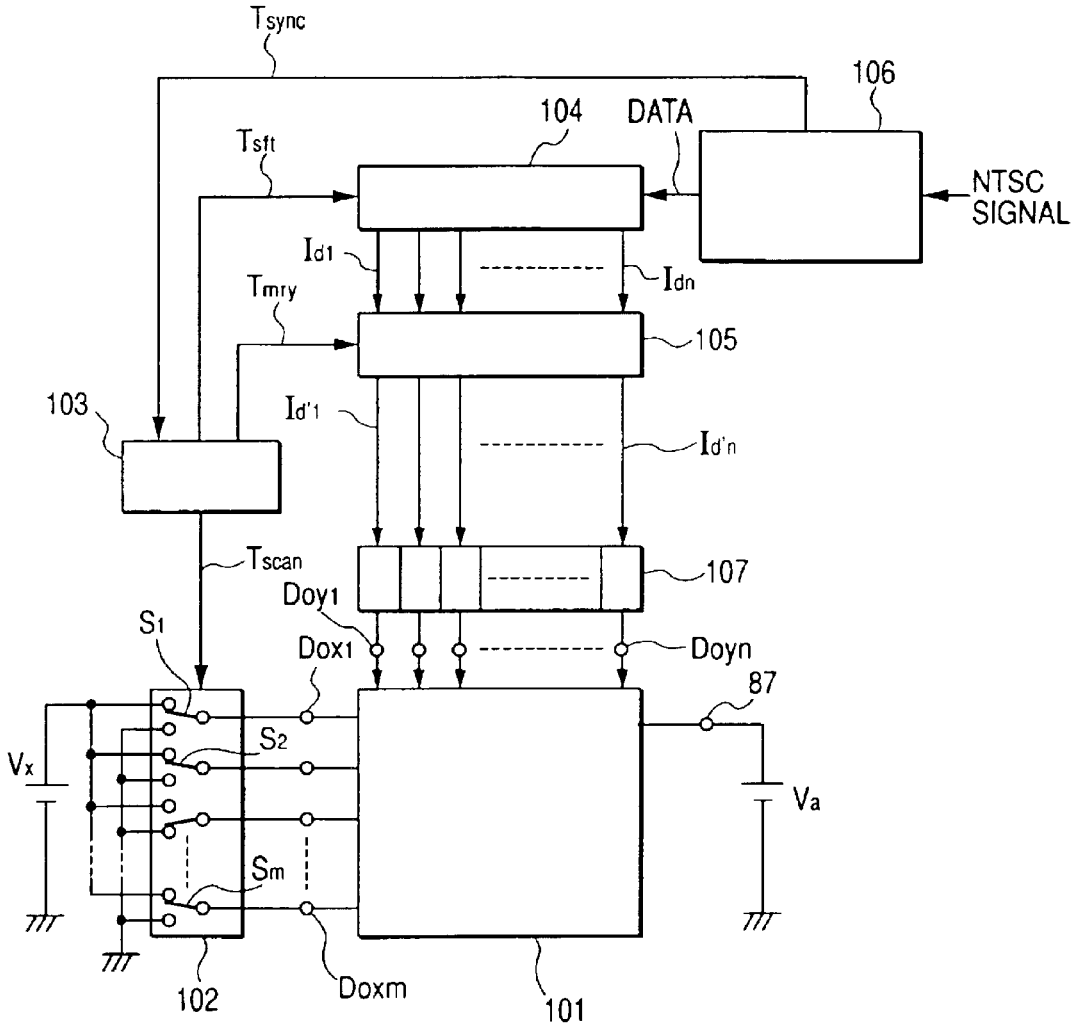
FIG. 14 is a block diagram of a driving circuit for displaying an image according to television signals of the NTSC system in the application of the electron-emitting devices of the present invention to the image-forming apparatus.

Next described referring to FIG. 14 is a structural example of the driving circuit for performing the television display based on TV signals of the NTSC system, on the display panel constructed using the electron source of the simple matrix configuration.

FIG. 14 is a block diagram to show an example of the driving circuit for effecting the display according to the TV signals of the NTSC system. In FIG. 14, numeral 101 designates the display panel which corresponds to the envelope 88 described above, 102 a scanning signal generating circuit, 103 a timing control circuit, and 104 a shift register. Numeral 105 denotes a line memory, 106 a synchronous signal separator, 107 a modulation signal generator, and Vx and Va dc voltage supplies.

The display panel 101 is connected to the external, electric circuits through the terminals Dox1 to Doxm, the terminals Doy1 to Doyn, and the high-voltage terminal 87. Applied to the terminals Dox1 to Doxm are scanning signals for successively driving the electron source provided in the display panel 101, i.e., a group of surface conduction electron-emitting devices matrix-wired in a matrix of m rowsxn columns row by row (every n devices).

Applied to the terminals Doy1 to Doyn are modulation signals for controlling an output electron beam from each of surface conduction electron-emitting devices in a row selected by the scanning signal. The dc voltage, for example, of 10 kV is supplied from the dc voltage supply Va to the high-voltage terminal 87, and this is the acceleration voltage for imparting sufficient energy for excitation of the fluorescent material to the electron beams emitted from the electron-emitting devices.

The scanning signal generating circuit 102 is provided with m switching devices inside (which are schematically indicated by S1 to Sm in the drawing). Each switching device selects either the output voltage of the dc voltage supply Vx or 0 V (the ground level) to be electrically connected to the terminal Dox1 to Doxm of the display panel 101. Each switching device of S1 to Sm operates based on the control signal Tscan outputted from the control circuit 103, and can be constructed of a combination of such switching devices as FETs, for example.

The dc voltage supply Vx in the present example is so set as to output such a constant voltage that the driving voltage applied to the devices not scanned based on the characteristics (the electron emission threshold voltage) of the surface conduction electron-emitting devices is not more than the electron emission threshold voltage.

The timing control circuit 103 has a function of matching operations of the respective sections so as to achieve the appropriate display based on the image signals supplied from the outside. The timing control circuit 103 generates each control signal of Tscan, Tsft, and Tmry to each section, based on the synchronous signal Tsync sent from the synchronous signal separator 106.

The synchronous signal separator 106 is a circuit for separating a synchronous signal component and a luminance signal component from the TV signal of the NTSC method supplied from the outside, which can be constructed using an ordinary frequency separator (filter) circuit or the like. The synchronous signal separated by the synchronous signal separator 106 is composed of a vertical synchronous signal and a horizontal synchronous signal, but it is illustrated as a Tsync signal herein for convenience' sake of description. The luminance signal component of image separated from the aforementioned TV signal is indicated by DATA signal for convenience' sake. The DATA signal is inputted into the shift register 104.

The shift register 104 is a register for performing serial/parallel conversion for each line of image of the aforementioned DATA signal serially inputted in time series, which operates based on the control signal Tsft sent from the timing control circuit 103 (this means that the control signal Tsft can be said to be a shift clock of the shift register 104). The data of each image line after the serial/parallel conversion (corresponding to the driving data for the n electron-emitting devices) is outputted as n parallel signals of Id1 to Idn from the shift register 104.

The line memory 105 is a storage device for storing the data of one image line during a necessary period, which properly stores the data of Id1 to Idn according to the control signal Tmry sent from the timing control circuit 103. The stored data is outputted as Id'1 to Id'n to the modulation signal generator 107.

The modulation signal generator 107 is a signal source for properly modulating driving of each of the electron-emitting devices according to each of the image data Id'1 to Id'n, and output signals therefrom are applied through the terminals Doy1 to Doyn to the surface conduction electron-emitting devices in the display panel 101.

As described previously, the electron-emitting devices, to which the present invention can be applied, have the following fundamental characteristics concerning the emission current Ie. Specifically, there is the definite threshold voltage Vth for electron emission, so that electron emission occurs only upon application of the voltage over Vth. With voltages over the electron emission threshold voltage, the emission current also varies according to change in the voltage applied to the device. It is seen from this fact that when pulses of the voltage are applied to the present devices, no electron emission occurs with application of the voltage below the electron emission threshold voltage, but the electron beams are outputted with application of the voltage over the electron emission threshold, for example. On that occasion, the intensity of output electron beam can be controlled by changing the peak value Vm of the pulses. It is also possible to control a total amount of charge of the output electron beam by changing the width Pw of the pulses. Accordingly, the voltage modulation method, the pulse width modulation method, or the like can be employed as a method for modulating the electron-emitting devices according to the input signal.

For carrying out the voltage modulation method, the modulation signal generator 107 can be a circuit of the voltage modulation method for generating voltage pulses of a constant length and properly modulating peak values of the pulses according to input data.

For carrying out the pulse width modulation method, the modulation signal generator 107 can be a circuit of the pulse width modulation method for generating voltage pulses of a constant peak value and properly modulating widths of the voltage pulses according to the input data.

The shift register 104 and the line memory 105 can be of either the digital signal type or the analog signal type. The point is that the serial/parallel conversion and storage of image signal should be carried out at a predetermined rate.

For use of the digital signal type, the output signal DATA of the synchronous signal separator 106 needs to be digitized. For this purpose, the output section of the synchronous signal separator 106 is provided with an A/D converter. In connection with it, the circuit used in the modulation signal generator 107 will slightly differ depending upon whether the output signals of the line memory 105 are digital signals or analog signals. In the case of the voltage modulation method using digital signals, the modulation signal generator 107 is, for example, a D/A converter and an amplifier is added if necessary. In the case of the pulse width modulation method, the modulation signal generator 107 is a circuit, for example, comprised of a high-speed oscillator, a counter for counting waves outputted from the oscillator, and a comparator for comparing an output value of the counter with an output value of the memory. The circuit may also be provided with an amplifier for amplifying the voltage of the modulation signal modulated in the pulse width from the comparator to the driving voltage of the electron-emitting devices, if necessary.

In the case of the voltage modulation method using analog signals, the modulation signal generator 107 can be an amplifying circuit, for example, using an operational amplifier and may also be provided with a level shift circuit if necessary. In the case of the pulse width modulation method, a voltage-controlled oscillator (VCO) can be employed, for example, and it can also be provided with an amplifier for amplifying the voltage to the driving voltage of the electron-emitting devices, if necessary.

In the image-forming apparatus to which the present invention can be applied and which can be constructed as described above, electron emission occurs when the voltage is applied through the terminals Dox1 to Doxm, Doy1 to Doyn outside the container to each electron-emitting device. The electron beams are accelerated by applying the high voltage through the high voltage terminal 87 to the metal back 85 or to the transparent electrode (not illustrated). The electrons thus accelerated collide with the fluorescent film 84 to bring about luminescence, thus forming the image.

It should be noted that the structure of the image-forming apparatus stated herein is just an example of the image-forming apparatus to which the present invention can be applied, and it can involve a variety of modifications based on the technological thought of the present invention. Although the NTSC system was exemplified for the input signals, the input signals can be of the PAL system, the SECAM system, or the like, or a system of TV signals including more scanning lines (for example, one of high-definition TV systems including the MUSE system) without having to be limited to the NTSC system.

The image-forming apparatus of the present invention can be applied to the display devices for television broadcasting system, the display devices for television conference systems, computers, and so on, the image-forming apparatus as an optical printer constructed using a photosensitive drum etc., and so on.

EXAMPLES

The present invention will be described in further detail with examples thereof.

Example 1

The basic structure of the electron-emitting device in the present example is the same as that illustrated in the plan view and sectional view of FIG. 1A and FIG. 1B and in the enlarged plan view and sectional view of FIG. 2A and FIG. 2B.

The production method of the surface conduction electron-emitting device in the present example is fundamentally the same as that illustrated in FIGS. 5A to 5C and FIGS. 7A to 7D. The basic structure and production method of the device according to the present example will be described referring to FIGS. 1A, 1B, FIGS. 2A, 2B, FIGS. 5A to 5C, and FIGS. 7A to 7D.

The production method will be described below in order referring to FIGS. 1A, 1B, FIGS. 2A, 2B, FIGS. 5A to 5C, and FIGS. 7A to 7D.

(Step-a)

First, a photoresist (RD-2000N-41 available from Hitachi Kasei) was formed in the pattern expected to become the device electrodes 2, 3 and the desired gap L between the device electrodes on quartz substrate 1 after cleaned, and Ti and Pt were successively deposited in the thickness of 5 nm and in the thickness of 30 nm, respectively, by electron beam evaporation. Then the photoresist pattern was dissolved with an organic solvent and the Pt/Ti deposited films were lifted off, thereby forming the device electrodes 2, 3 having the device electrode gap L of 3 $\mu$m and the device electrode width W of 500 $\mu$m (FIG. 5A).

(Step-b)

A Cr film was deposited in the thickness 100 nm by vacuum evaporation and was patterned so as to form an aperture corresponding to the shape of the conductive film described hereinafter. An organic palladium compound solution (ccp4230 available from Okuno Seiyaku K.K.) was applied onto the film by spin coating with a spinner and it was baked at 300° C. for twelve minutes. The conductive film 4 containing the principal element of palladium oxide, thus made, had the thickness of 10 nm and the sheet resistance Rs of $2\times10^4$ Ω/□.

(Step-c)

The Cr film and the conductive film 4 after baked were etched with an acid etchant, thereby forming the conductive film 4 in the width W' of 300 $\mu$m and in the desired pattern (FIG. 5B).

According to the above steps, the device electrodes 2, 3 and conductive film 4 were formed on the substrate 1.

The devices of Comparative Examples 1 and 2 were also produced by the same steps.

(Step-d)

Then the above device was set in the measurement-evaluation system of FIG. 4 and the inside was evacuated by the vacuum pump. After the pressure reached the vacuum level of $1\times10^{-6}$ Pa, the voltage was placed between the device electrodes 2, 3 of the device from the power supply 41 for applying the device voltage Vf to the device, thus carrying out the forming operation. This operation formed the second gap 7 in the conductive film 4, so as to separate it into the conductive films 4*a*, 4*b* (FIG. 5C or FIG. 7A). The voltage waveform in the forming operation was that shown in FIG. 6B.

In FIG. 6B, T1 and T2 indicate the pulse width and pulse spacing of the voltage waveform. In the present example, the forming operation was carried out under such conditions that T1 was 1 msec, T2 was 16.7 msec, and the peak values of the triangular waves were increased in steps of 0.1 V. During the forming operation a resistance measuring pulse at the voltage of 0.1 V was also interposed between the pulses for the forming and the resistance was measured thereby. The end of the forming operation was determined at the time when a measured value by the resistance measuring pulse became not less than about 1 MΩ and, at the same time, application of the voltage to the device was terminated.

(Step-e)

For carrying out the activation step next, tolunitrile was introduced through a slow leak valve into the vacuum chamber and the pressure of $1.3\times10^{-4}$ Pa was maintained. Then the activation operation was carried out on the device after the forming operation by applying the voltage of the waveform illustrated in FIG. 8A through the device electrodes 2, 3 to the device under the conditions that T1 was 1 msec, T2 was 10 msec, and the maximum voltage was ±15 V (FIG. 7A to FIG. 7D). At this time the voltage supplied to the device electrode 3 was positive, and the device current If was positive along the direction of flow from the device electrode 3 to the device electrode 2. After it was confirmed about 60 minutes after that the device current was in the region II of FIG. 9, the energization was stopped and the slow leak valve was closed, thereby terminating the activation operation.

On the other hand, activation under the following conditions was carried out on the devices of Comparative Examples 1 and 2 subjected to the same forming step as that of the device of the present example.

The device of Comparative Example 1: the same conditions as in the case of the device of the present example except that the partial pressure of introduction of tolunitrile was $1.3\times10^{-2}$ Pa.

The device of Comparative Example 2: the same conditions as in the case of the device of the present example except that the partial pressure of introduction of tolunitrile was $1.3\times10^{-6}$ Pa.

(Step-f)

Subsequently, the stabilization step was carried out. The vacuum chamber and electron-emitting device were heated by heater and evacuation of the inside of the vacuum chamber was carried on with maintaining the temperature at about 250° C. The heating by the heater was stopped 20 hours after and the temperature was decreased to the room temperature. The pressure inside the vacuum chamber at that time was approximately $1\times10^{-8}$ Pa.

Then the electron emission characteristics were measured.

The distance H between the anode electrode 44 and the electron-emitting device was set to 4 mm and the voltage of 1 kV was supplied from the high-voltage supply 43 to the anode electrode 44. In this state the rectangular pulse voltage with the peak value of 15 V was applied between the device electrodes 2, 3 by use of the power supply 41, and the device current If and emission current Ie were measured for each of the device of the present example and the devices of the comparative examples by use of the current meter 40 and current meter 42.

The device of the present example showed the following values; device current If=7.0 mA, emission current Ie=17.5 $\mu$A, and electron emission efficiency η(=Ie/If)=0.25%. The device of Comparative Example 1 showed the following values: device current If=7.0 mA, emission current Ie=5.0 $\mu$A, and electron emission efficiency η(=Ie/If)=0.07%. The device of Comparative Example 2 showed the following values: device current If=2.0 mA, emission current Ie=4.0 $\mu$A, and electron emission efficiency η(=Ie/If)=0.20%.

This result verified that the device of the present example had the greater emission current Ie and the higher electron emission efficiency η than the devices of the comparative examples.

The device of the present example and the devices of the comparative examples produced through the above steps were observed with an atomic force microscope (AFM) and a transmission electron microscope (TEM).

First, the morphology of the plane including the electron-emitting region 5 of the devices was observed with the atomic force microscope. The shape of the device of the present example was similar to the shape of the plane illustrated in FIG. 2A. Namely, deposits 21*a*, 21*b* were observed on the both sides of the gap 7 formed in the conductive film 4. From information of height obtained by the atomic force microscope, the height of the highest portion of the deposits was about 80 nm high from the surface of the conductive films 4*a*, 4*b* and the deposits at that height had the beltlike shape having the width of about 50 nm. On the other hand, the deposits were also observed similarly in the device of Comparative Example 1, but the heights of the deposits were almost uniform and the beltlike shape observed in the device of the present example was not observed. When the device of Comparative Example 2 was observed, places with and without the deposits were scattered on the both sides of the second gap 7 formed in the conductive film.

Next, a cross section including the deposits of each device was observed using the transmission electron microscope.

From the result, the deposits near the first gap 8 of the device of the present example had the shape similar to the shape shown in FIG. 2B and the height of the portions corresponding to the deposits 21*a*, 21*b* were about 80 nm. The deposit 21*a* was connected via the conductive film 4*a* to the device electrode 2 of FIGS. 1A and 1B, while the deposit 21*b* was connected via the conductive film 4*b* to the device electrode 3 of FIGS. 1A and 1B. The deposits 21*a*, 21*b* were also formed on the conductive films 4*a*, 4*b* and their height was about 20 nm. The thickness of the part corresponding to the thickness D was further measured and the result was about 25 nm. The narrowest portion of the first gap 8 was present above the surface of the substrate and above the surface of the conductive film and the gap thereof (the distance between A and B in FIG. 2B) was about 3 nm.

The depth of the substrate-deteriorated portion (the depressed portion) was about 30 nm and a cavity was observed in the central part thereof.

In the device of Comparative Example 1, thick deposits covered the whole of the second gap part 7 formed in the conductive film and the shape as illustrated in FIG. 2B was not observed.

Further, in the device of Comparative Example 2, because a deposition amount of deposits was small, the precise shape thereof was not able to specify.

Finally, the deposits near the gap 7 formed in the conductive film of the device of the present example were subjected to element analysis with electron probe microanalysis (EPMA), X-ray photoelectron spectroscopy (XPS), and Auger electron spectroscopy, and it was verified that the deposits were carbon films containing carbon as a matrix.

It was verified from these observation results that in the device of the present example the deposits 21*a*, 21*b* deposited were the carbon films containing graphite-like carbon as a matrix, the substrate-deteriorated portion 22 had the cavity, and the device had the shape similar to that illustrated in FIG. 2B. Therefore, good electron emission was achieved with large emission current Ie and high emission efficiency η. Further, the devices of Example 1 and Comparative Examples 1, 2 were driven for the same time and it was verified that the devices of the comparative examples demonstrated earlier degradation of electron emission characteristics than the device of the present example, part of the devices of the comparative examples showed quick degradation of the device characteristics possibly due to discharge, and the device of the present example had stable characteristics with little degradation.

Example 2

In the present example the steps similar to those in Example 1 were carried out up to step-d. The substrate 1 was a substrate obtained by coating a soda lime glass substrate with $SiO_2$.

(Step-e)

For carrying out the activation step next, acrylonitrile was introduced through the slow leak valve into the vacuum chamber and the pressure of $1.3\times10^{-2}$ Pa was maintained. Then the activation operation was carried out on the device after the forming operation by applying the voltage of the waveform illustrated in FIG. 8A through the device electrodes 2, 3 to the device under the conditions that T1 was 1 msec, T2 was 10 msec, and the maximum voltage was ±15 V. At this time the voltage supplied to the device electrode 3 was positive, and the device current If was positive along the direction of flow from the device electrode 3 to the device electrode 2. After it was confirmed about 45 minutes after that the device current was in the region II of FIG. 9, the energization was stopped and the slow leak valve was closed, thereby terminating the activation operation.

On the other hand, activation under the following conditions was carried out on the devices of Comparative Examples 3, 4 subjected to the same forming step as that of the device of the present example.

The device of Comparative Example 3: the same conditions as in the case of the device of the present example except that the partial pressure of introduction of acrylonitrile was 1.3 Pa.

The device of Comparative Example 4: the same conditions as in the case of the device of the present example except that the partial pressure of introduction of acrylonitrile was $1.3\times10^{-4}$ Pa.

(Step-f)

Subsequently, the stabilization step was carried out. The vacuum chamber and electron-emitting device were heated by heater and evacuation of the inside of the vacuum chamber was carried on with maintaining the temperature at about 250° C. The heating by the heater was stopped 20 hours after and the temperature was decreased to the room temperature. The pressure inside the vacuum chamber at that time was approximately $1\times10^{-8}$ Pa.

Then the electron emission characteristics were measured.

The distance H between the anode electrode 44 and the electron-emitting device was set to 4 mm and the voltage of 1 kV was supplied from the high-voltage supply 43 to the anode electrode 44. In this state the rectangular pulse voltage with the peak value of 15 V was applied between the device electrodes 2, 3 by use of the power supply 41, and the device current If and emission current Ie were measured for each of the device of the present example and the devices of the comparative examples by use of the current meter 40 and current meter 42.

The device of the present example showed the following values; device current If=5.5 mA, emission current Ie=14.0 μA, and electron emission efficiency η(=Ie/If)=0.24%. The device of Comparative Example 3 showed the following values: device current If=7.5 mA, emission current Ie=5.5 μA, and electron emission efficiency η(=Ie/If)=0.07%. The device of Comparative Example 4 showed the following values: device current If=4.0 mA, emission current Ie=10.0 μA, and electron emission efficiency η(=Ie/If)=0.25%.

This result verified that the device of the present example had the greater emission current Ie and the higher electron emission efficiency η than the devices of the comparative examples.

The device of the present example produced through the above steps was observed with the atomic force microscope (AFM) and the transmission electron microscope (TEM) in a similar fashion as in Example 1. It was then verified that the shape of the device of the present example had the deposits 21*a*, 21*b* similar to the shape illustrated in FIGS. 2A and 2B. In the device of the present example the height of the portions corresponding to the deposits 21*a*, 21*b* in FIG. 2B was about 60 nm. Further, the thickness of the part corresponding to the thickness D was measured and it was about 20 nm. The depth of the substrate-deteriorated portion (depressed portion) was about 40 nm and a cavity was observed in the central part thereof. The narrowest portion of the first gap 8 was present above the surface of the substrate and above the surface of the conductive film and the gap thereof (the distance between A and B in FIG. 2B) was about 4 nm.

Finally, the deposits near the gap formed in the conductive film of the device of the present example was subjected to the element analysis with EPMA, X-ray photoelectron spectroscopy (XPS), and Auger electron spectroscopy, and it was verified that the deposits were the carbon films containing carbon as a matrix.

It was verified from these observation results that in the device of the present example the deposits 21*a*, 21*b* were also the carbon films containing graphite-like carbon as a matrix and the device had the shape similar to that illustrated in FIG. 2B. Therefore, good electron emission was achieved with large emission current Ie and high emission efficiency η. Further, the devices of Example 2 and Comparative Examples 3, 4 were driven for the same time and it was verified that the devices of the comparative examples demonstrated earlier degradation of the electron emission characteristics than the device of the present example, the phenomenon possibly due to discharge was observed in the devices of the comparative examples, and the device of the present example had the very stable characteristics.

Example 3

The basic structure of the electron-emitting device according to the present example is similar to that in the plan view and sectional view of FIGS. 1A and 1B and the enlarged plan view and sectional view of FIGS. 3A and 3B.

In the present example, the steps similar to those in Example 1 were carried out up to step-d.

(Step-e)

For carrying out the activation step next, tolunitrile was introduced through a slow leak valve into the vacuum chamber and the pressure of $1.3\times10^{-4}$ Pa was maintained. Then the activation operation was carried out on the device after the forming operation by applying the voltage of the waveform illustrated in FIG. 8B through the device electrodes 2, 3 to the device under the conditions that T1 was 2 msec, T1' was 1 msec, T2 was 10 msec, and the maximum voltage was ±15 V. At this time the voltage supplied to the device electrode 3 was positive, and the device current If was positive along the direction of flow from the device electrode 3 to the device electrode 2. After it was confirmed about 30 minutes after that the device current was in the region II of FIG. 9, the energization was stopped and the slow leak valve was closed, thereby terminating the activation operation.

On the other hand, activation under the following conditions was carried out on the devices of Comparative Examples 5, 6 subjected to the same forming step as that of the device of the present example.

The device of Comparative Example 5: the same conditions as in the case of the device of the present example except that the partial pressure of introduction of tolunitrile was $1.3\times10^{-2}$ Pa.

The device of Comparative Example 6: the same conditions as in the case of the device of the present example except that the partial pressure of introduction of tolunitrile was $1.3\times10^{-6}$ Pa.

(Step-f)

Subsequently, the stabilization step was carried out. The vacuum chamber and electron-emitting device were heated by heater and evacuation of the inside of the vacuum chamber was carried on with maintaining the temperature at about 250° C. The heating by the heater was stopped 20 hours after and the temperature was decreased to the room temperature. The pressure inside the vacuum chamber at that time was approximately $1\times10^{-8}$ Pa.

Then the electron emission characteristics were measured.

The distance H between the anode electrode 44 and the electron-emitting device was set to 4 mm and the voltage of 1 kV was supplied from the high-voltage supply 43 to the anode electrode 44. In this state the rectangular pulse voltage with the peak value of 15 V was applied between the device electrodes 2, 3 by use of the power supply 41, and the device current If and emission current Ie were measured for each of the device of the present example and the devices of the comparative examples by use of the current meter 40 and current meter 42.

The device of the present example showed the following values; device current If=7.0 mA, emission current Ie=18.5 μA, and electron emission efficiency η(=Ie/If)=0.26%. The device of Comparative Example 5 showed the following values: device current If=7.0 mA, emission current Ie=5.0 μA, and electron emission efficiency η(=Ie/If)=0.07%. The device of Comparative Example 6 showed the following values: device current If=2.0 mA, emission current Ie=4.0 μA, and electron emission efficiency η(=Ie/If)=0.20%.

This result verified that the device of the present example had the greater emission current Ie and the higher electron emission efficiency η than the devices of the comparative examples.

The device of the present example and the devices of the comparative examples produced through the above steps were observed with the atomic force microscope (AFM) and the transmission electron microscope (TEM) in a similar manner as in Example 1.

First, the morphology of the plane including the electron-emitting region 5 of the devices was observed with the atomic force microscope. The shape of the device of the present example was similar to the shape of the plane illustrated in FIG. 3A. Namely, deposits 21*a*, 21*b* were observed on the both sides of the gap 7 formed in the conductive film 4. From information of height obtained by the atomic force microscope, the height of the highest portion of the deposits was about 50 nm high from the surface of the conductive films and the deposits at that height had the beltlike shape having the width of about 50 nm. On the other hand, the deposits were also observed in the device of Comparative Example 5, but the heights of the deposits were almost uniform and the beltlike shape observed in the device of the present example was not observed. When the device of Comparative Example 6 was observed, places with and without the deposits were scattered on the both sides of the gap formed in the conductive film.

Next, a cross section including the deposits of each device was observed using the transmission electron microscope.

From the result, the deposits near the gap 8 of the device of the present example had the shape similar to the shape shown in FIG. 3B, the height of the portion corresponding to the deposit 21*a* was about 30 nm, and the height of the portion corresponding to the deposit 21*b* was about 50 nm. The deposit 21*a* was connected via the conductive film 4*a* to the device electrode 2 of FIGS. 1A and 1B, while the deposit 21*b* was connected via the conductive film 4*b* to the device electrode 3 of FIGS. 1A and 1B. The thickness of the part corresponding to the thickness D was further measured and the result was about 25 nm. The narrowest portion of the first gap 8 was present above the surface of the substrate and above the surface of the conductive film and the gap thereof (the distance between A and B in FIG. 2B) was about 3 nm.

The depth of the substrate-deteriorated portion (the depressed portion) was about 30 nm and a cavity was observed in the central part thereof.

On the other hand, in the device of Comparative Example 5, thick deposits covered the whole of the gap part formed in the conductive film and the shape as illustrated in FIG. 3B was not observed.

Further, in the device of Comparative Example 6, because a deposition amount of deposits was small, the precise shape thereof was not able to specify.

Finally, the deposits near the gap formed in the conductive film of the device of the present example was subjected to the element analysis with electron probe microanalysis (EPMA), X-ray photoelectron spectroscopy (XPS), and Auger electron spectroscopy, and it was verified that the deposits were the carbon films containing carbon as a matrix.

It was verified from these observation results that in the device of the present example the deposits 21*a*, 21*b* deposited were the carbon films containing graphite-like carbon as a matrix, the substrate-deteriorated portion 22 had the cavity, and the device had the shape similar to that illustrated in FIG. 3B. Therefore, good electron emission was achieved with large emission current Ie and high emission efficiency η. Further, the devices of Example 3 and Comparative Examples 5, 6 were driven for the same time and it was verified that the devices of the comparative examples demonstrated earlier degradation of electron emission characteristics than the device of the present example, part of the devices of the comparative examples showed quick degradation of the device characteristics possibly due to discharge, and the device of the present example had stable characteristics with little degradation.

Example 4

The basic structure of the electron-emitting device according to the present example is similar to that in Example 3 and thus similar to that in the plan view and sectional view of FIGS. 1A and 1B and the enlarged plan view and sectional view of FIGS. 3A and 3B.

In the present example, the steps similar to those in Example 1 were carried out up to step-d.

(Step-e)

For carrying out the activation step next, acrylonitrile was introduced through the slow leak valve into the vacuum chamber and the pressure of $1.3\times10^{-2}$ Pa was maintained. Then the activation operation was carried out on the device after the forming operation by applying the voltage of the waveform illustrated in FIG. 8B through the device electrodes 2, 3 to the device under the conditions that T1 was 1 msec, T1' was 0.5 msec, T2 was 10 msec, and the maximum voltage was ±14 V. At this time the voltage supplied to the device electrode 3 was positive, and the device current If was positive along the direction of flow from the device electrode 3 to the device electrode 2. After it was confirmed about 30 minutes after that the device current was in the region II of FIG. 9, the energization was stopped and the slow leak valve was closed, thereby terminating the activation operation.

On the other hand, activation under the following conditions was carried out on the devices of Comparative Examples 7, 8 subjected to the same forming step as that of the device of the present example.

The device of Comparative Example 7: the same conditions as in the case of the device of the present example except that the partial pressure of introduction of acrylonitrile was 1.3 Pa.

The device of Comparative Example 8: the same conditions as in the case of the device of the present example except that the partial pressure of introduction of acrylonitrile was $1.3\times10^{-4}$ Pa.

(Step-f)

Subsequently, the stabilization step was carried out. The vacuum chamber and electron-emitting device were heated by heater and evacuation of the inside of the vacuum chamber was carried on with maintaining the temperature at about 250° C. The heating by the heater was stopped 20 hours after and the temperature was decreased to the room temperature. The pressure inside the vacuum chamber at that time was approximately $1\times10^{-8}$ Pa.

Then the electron emission characteristics were measured.

The distance H between the anode electrode 44 and the electron-emitting device was set to 4 mm and the voltage of 1 kV was supplied from the high-voltage supply 43 to the anode electrode 44. In this state the rectangular pulse voltage with the peak value of 15 V was applied between the device electrodes 2, 3 by use of the power supply 41, and the device current If and emission current Ie were measured for each of the device of the present example and the devices of the comparative examples by use of the current meter 40 and current meter 42.

The device of the present example showed the following values; device current If=5.5 mA, emission current Ie=15.0 μA, and electron emission efficiency η(=Ie/If)=0.27%. The device of Comparative Example 7 showed the following values: device current If=7.5 mA, emission current Ie=5.5 μA, and electron emission efficiency η(=Ie/If)=0.07%. The device of Comparative Example 8 showed the following values: device current If=4.0 mA, emission current Ie=10.0 μA, and electron emission efficiency η(=Ie/If)=0.25%.

This result verified that the device of the present example had the greater emission current Ie and the higher electron emission efficiency η than the devices of the comparative examples.

The device of the present example and the devices of the comparative examples produced through the above steps were observed with the atomic force microscope (AFM) and the transmission electron microscope (TEM) in a similar fashion as in Example 1. It was then verified that the shape of the device of the present example had the deposits 21*a*, 21*b* similar to the shape illustrated in FIGS. 3A and 3B. In the device of the present example the height of the portion corresponding to the deposit 21*a* in FIG. 3B was about 20 nm, and the height of the portion corresponding to the deposit 21*b* was about 40 nm. Further, the thickness of the part corresponding to the thickness D was measured and it was about 20 nm. The depth of the substrate-deteriorated portion (depressed portion) was about 40 nm and a cavity was observed in the central part thereof. The narrowest portion of the first gap 8 was present above the surface of the substrate and above the surface of the conductive film and the gap thereof (the distance between A and B in FIG. 2B) was about 4 nm.

Finally, the deposits near the gap formed in the conductive film of the device of the present example was subjected to the element analysis with EPMA, X-ray photoelectron spectroscopy (XPS), and Auger electron spectroscopy, and it was verified that the deposits were the carbon films containing carbon as a matrix.

It was verified from these observation results that in the device of the present example the deposits 21*a*, 21*b* were also the carbon films containing graphite-like carbon as a matrix and the device had the shape similar to that illustrated in FIG. 3B. Therefore, good electron emission was achieved with large emission current Ie and high emission efficiency η. Further, the devices of Example 4 and Comparative Examples 7, 8 were driven for the same time and it was verified that the devices of the comparative examples demonstrated earlier degradation of the electron emission characteristics than the device of the present example, the phenomenon possibly due to discharge was observed in the devices of the comparative examples, and the device of the present example had the very stable characteristics.

Example 5

Figure 15:
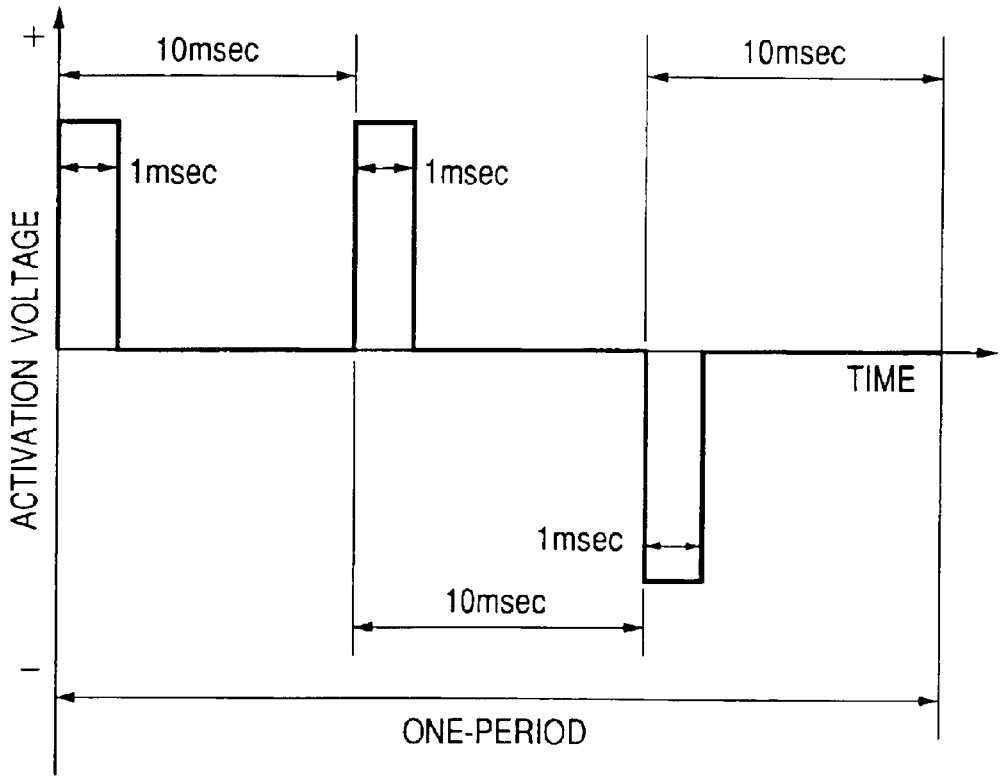
FIG. 15 is a schematic diagram of voltage waveform used in the activation step in Example 5 of the present invention.

In the present example the steps similar to those in Example 3 were carried out except that the waveform of the applied voltage illustrated in FIG. 15 was used in the activation operation of step-f.

The results were that the deposits 21*a*, 21*b* were the carbon films containing graphite-like carbon as a matrix, they had the shape similar to that illustrated in FIG. 3B, and good electron emission was achieved with large emission current Ie and high emission efficiency η, as in Example 3.

Example 6

Figure 16A:
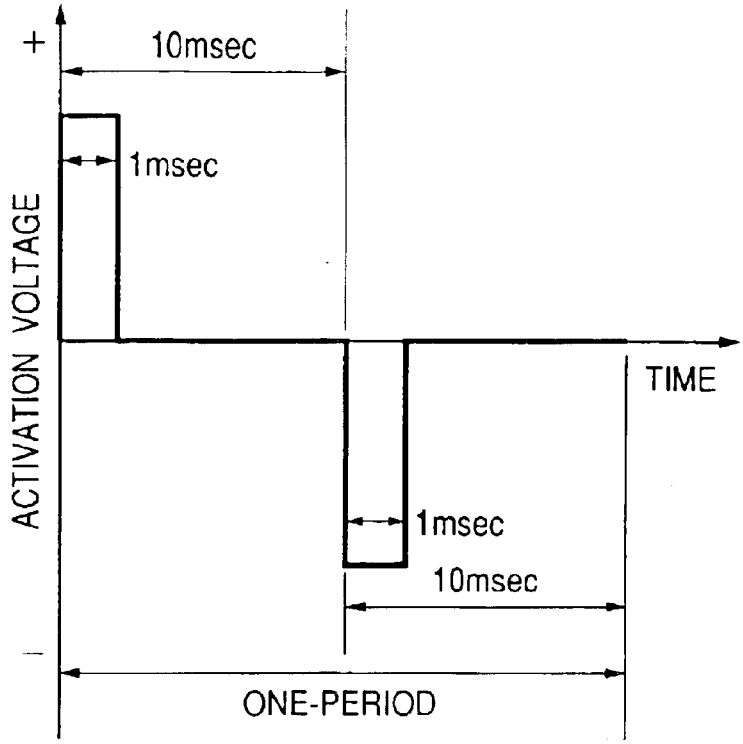
FIG. 16A and FIG. 16B are schematic diagrams of voltage waveforms used in the activation step in Example 6 of the present invention.
Figure 16B:
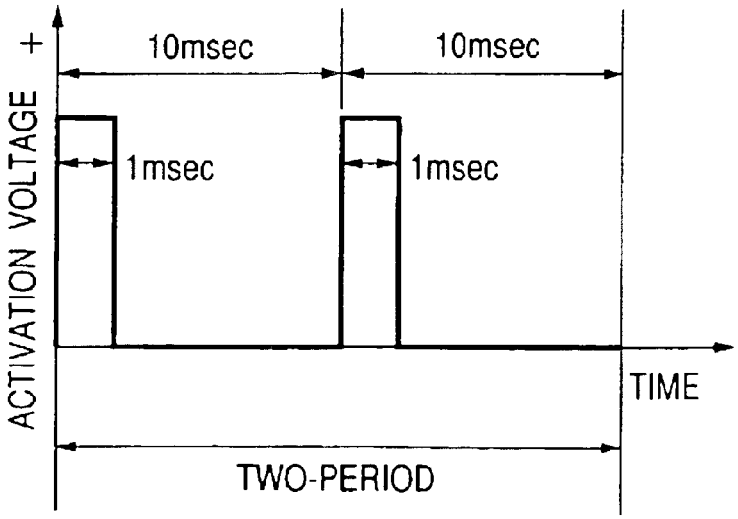

In the present example the steps similar to those in Example 3 were carried out except that the waveform of the applied voltage illustrated in FIG. 16A was first applied for twenty minutes and then the waveform of the applied voltage illustrated in FIG. 16B was applied for ten minutes in the activation operation of step-f.

The results were that the deposits 21*a*, 21*b* were the carbon films containing graphite-like carbon as a matrix, they had the shape similar to that illustrated in FIG. 3B, and good electron emission was achieved with large emission current Ie and high emission efficiency η, as in Example 3.

Example 7

The present example is an example of the image-forming apparatus with the electron source in which a lot of surface conduction electron-emitting devices are arrayed in the simple matrix configuration.

Figure 17:
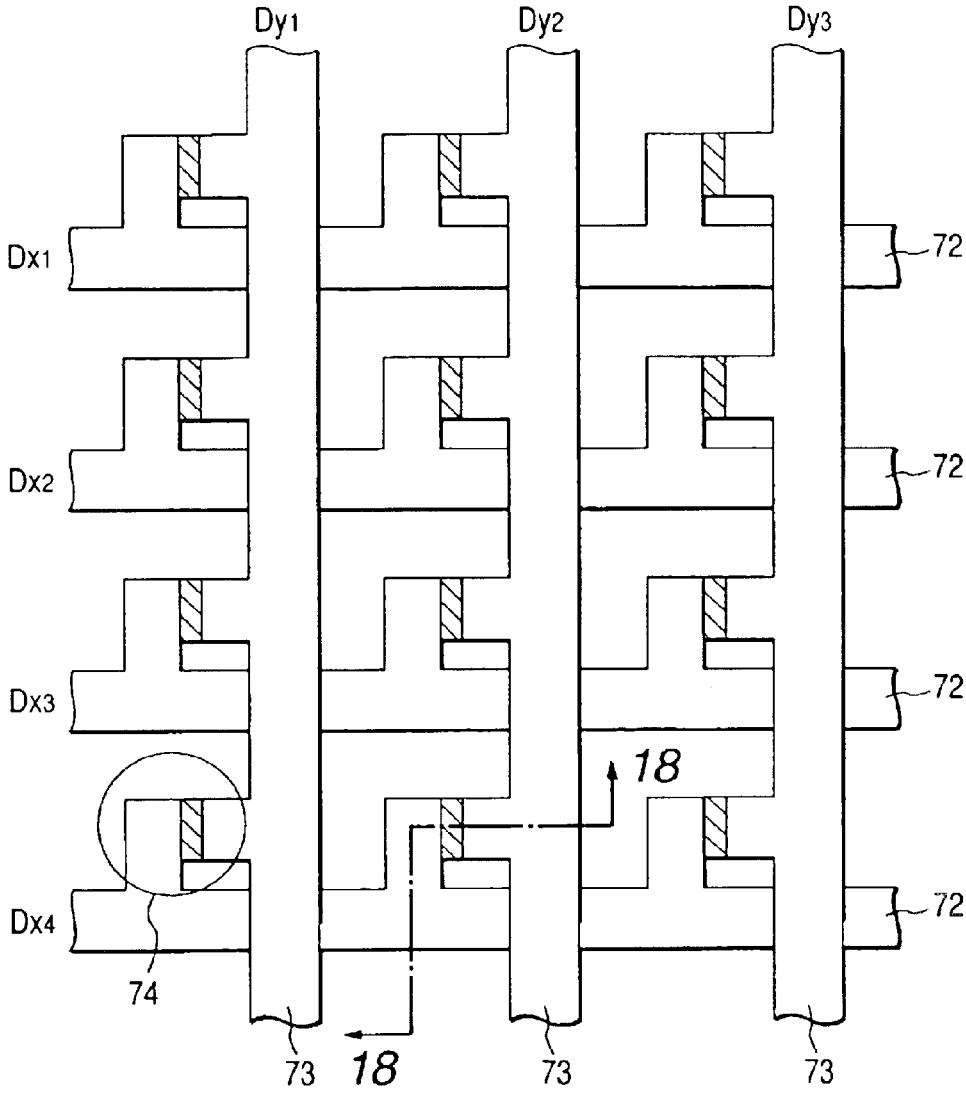
FIG. 17 is a schematic diagram to show an example of application to the electron source in which the electron-emitting devices of the present invention are arrayed in the passive matrix configuration.
Figure 18:
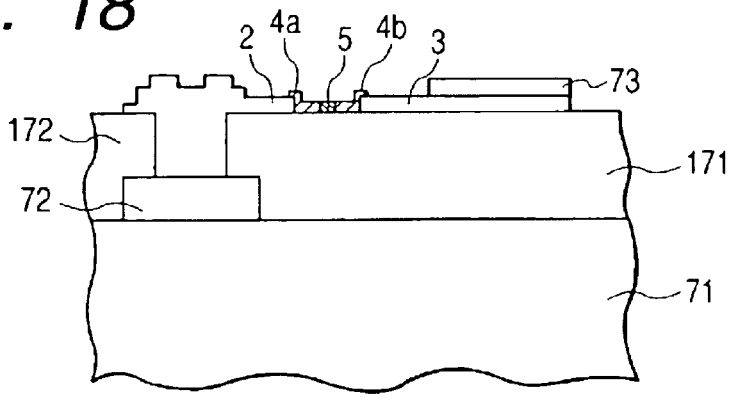
FIG. 18 is a partially sectional, schematic diagram along a broken line 18—18 of FIG. 17.

A plan view of a part of the electron source substrate is illustrated in FIG. 17. A sectional view along a broken line 18—18 of FIG. 17 is illustrated in FIG. 18. In FIG. 17 and FIG. 18 the same symbols denote the same elements. Numeral 71 designates the substrate, 72 the X-directional wires (also called lower wires) corresponding to Dxm of FIG. 11, 73 the Y-directional wires (also called upper wires) corresponding to Dyn of FIG. 11, 2 and 3 the device electrodes, 4 the conductive film, 171 the interlayer insulation layer, and 172 a contact hole for electrical connection between the device electrode 2 and the lower wire 72.

The production method will be described in detail according to the sequence of steps by reference to FIGS. 19A to 19D and FIGS. 20A to 20D.

(Step-a)

Figure 19A:
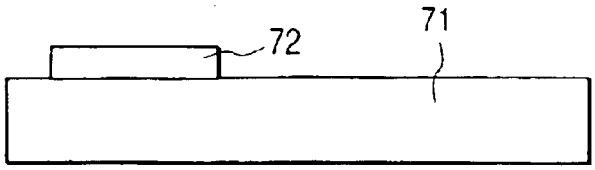
FIG. 19A, FIG. 19B, FIG. 19C, and FIG. 19D are schematic diagrams for explaining some of production steps of the electron source according to an embodiment of the present invention.

On the substrate 71 in which a silicon oxide film 0.5 μm thick was deposited by sputtering on a soda lime glass sheet after cleaned, Cr and Au were successively deposited in the thickness of 5 nm and in the thickness of 0.6 μm, respectively, by vacuum evaporation, and thereafter a photoresist (AZ1370 available from Heochst Inc.) was applied by spin coating with the spinner. Then the photoresist was baked and a photomask image was exposed and developed to form a resist pattern of the lower wires 72. Then the Au/Cr deposit film was wet-etched, thereby forming the lower wires 72 in the desired shape (FIG. 19A).

(Step-b)

Figure 19B:
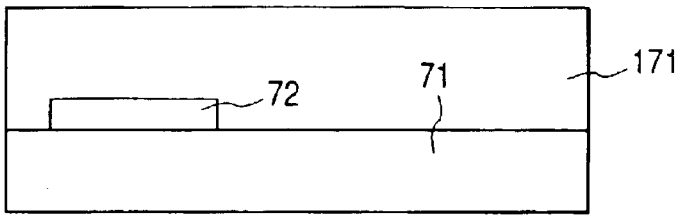

Then the interlayer insulation layer 171 of a silicon oxide film was deposited in the thickness of 1.0 μm by RF sputtering (FIG. 19B).

(Step-c)

Figure 19C:
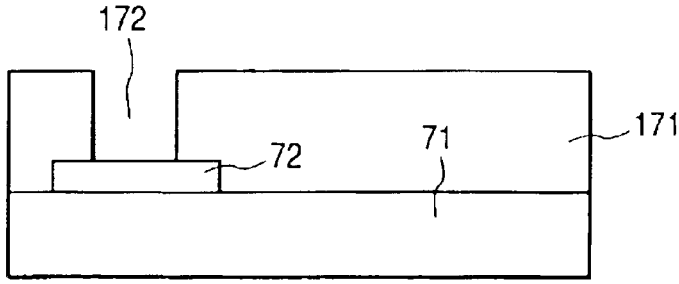

A photoresist pattern for formation of the contact holes 172 was made on the interlayer insulation layer 171 having been deposited in the step-b. Using this pattern as a mask, the interlayer insulation film 171 was etched to form the contact holes 172 therein (FIG. 19C).

(Step-d)

Figure 19D:
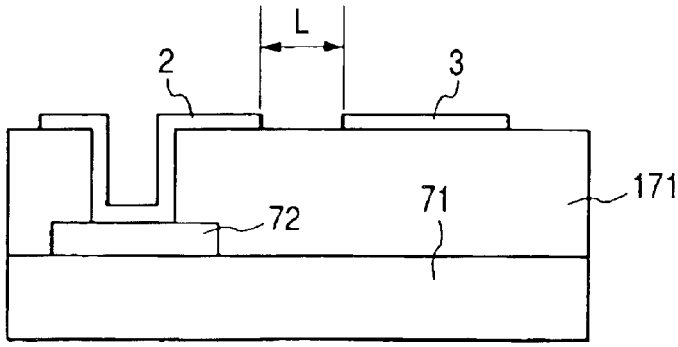

After that, a pattern expected to become the device electrodes 2, 3 and the device electrode gap L was formed with a photoresist (RD-2000N-41 available from Hitachi Kasei K.K.) and then Ti and Pt were successively deposited thereon in the thickness 5 nm and in the thickness 0.1 μm, respectively, by sputtering. The photoresist pattern was then dissolved with an organic solvent and the Pt/Ti deposit film was subjected to lift-off, thereby forming the device electrodes 2, 3 having the device electrode gap L=3 μm and the device electrode width W=0.3 mm (FIG. 19D).

(Step-e)

Figure 20A:
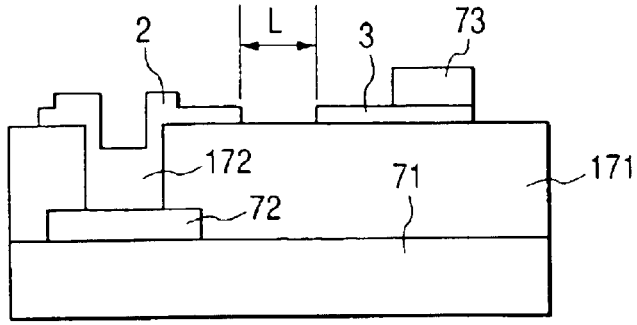
FIG. 20A, FIG. 20B, FIG. 20C, and FIG. 20D are schematic diagrams for explaining some of production steps of the electron source according to an embodiment of the present invention.

A photoresist pattern for the upper wires 73 was formed on the device electrodes 2, 3 and thereafter Ti and Au were successively deposited thereon in the thickness 5 nm and in the thickness 0.5 μm, respectively, by vacuum evaporation. Then unnecessary portions were removed by lift-off, thus forming the upper wires 73 in the desired shape (FIG. 20A).

(Step-f)

Figure 20B:
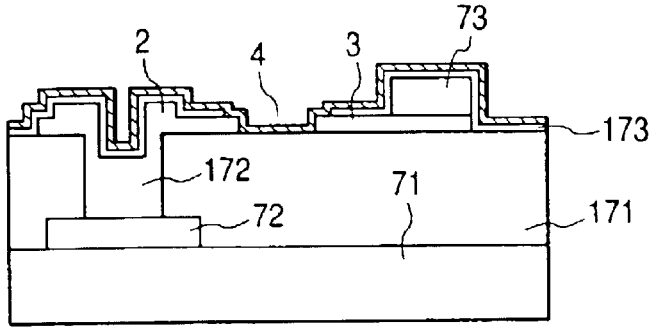

A Cr film 173 0.1 μm thick was deposited by vacuum evaporation and then patterned so as to have opening portions in the shape of the conductive film 4, an organic palladium compound solution (ccp4230 available from Okuno Seiyaku K.K.) was applied thereonto by spin coating with the spinner, and it was baked at 300° C. for ten minutes (FIG. 20B). The conductive film 4 thus made of fine particles of Pd as a principal element had the thickness of 10 nm and the sheet resistance of $2\times10^4$ Ω/□.

(Step-g)

Figure 20C:
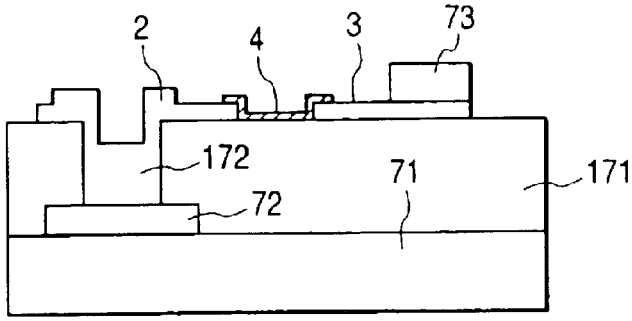

The Cr film 173 and the conductive film 4 after the baking were etched with an acid etchant to remove the film together with unnecessary portions of the conductive film, thereby forming the conductive film 4 in the desired pattern (FIG. 20C).

(Step-h)

Figure 20D:
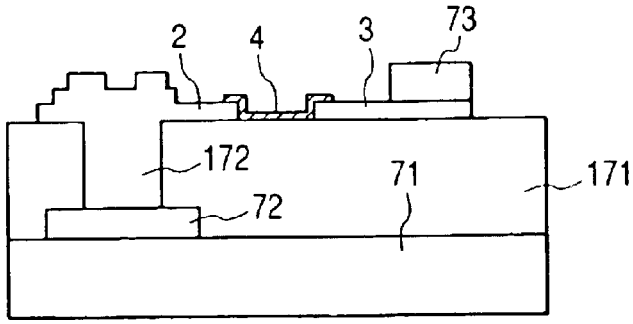
Figure 21:
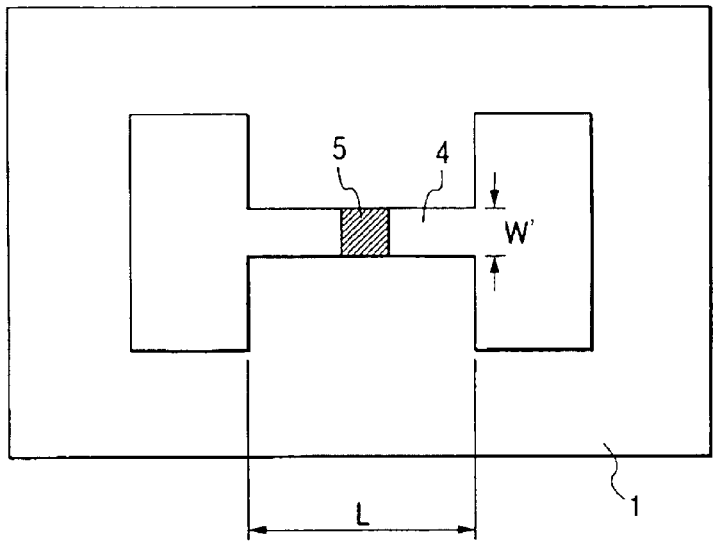
FIG. 21 is a schematic diagram to show the structure of a conventional electron-emitting device.
Figure 22:
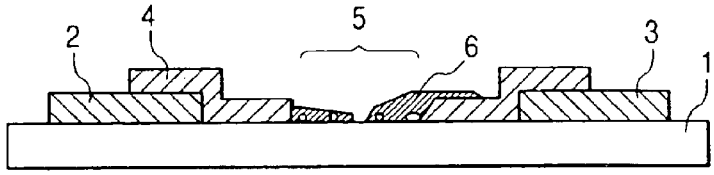
FIG. 22 is a schematic diagram to show the structure of another conventional electron-emitting device.

A resist pattern was formed so as to have opening portions of contact holes 172, and then Ti and Au were successively deposited thereon in the thickness 5 nm and in the thickness 0.5 μm, respectively, by vacuum evaporation. Then unnecessary portions were removed by lift-off, thereby filling the contact holes 172 (FIG. 20D).

According to the above steps, the lower wires 72, the interlayer insulation layer 171, the upper wires 73, the device electrodes 2, 3 and the conductive film 4 were formed on the insulating substrate 71.

Next described referring to FIG. 12 and FIG. 13A is an example of construction of an electron source and a display device using the electron source substrate produced as described above.

The substrate 71 having the devices fabricated as described above thereon was fixed on the rear plate 81, and the face plate 86 (in which the fluorescent film 84 and metal back 85 were formed on the inner surface of glass substrate 83) was placed 5 mm above the electron source substrate 71 through the support frame 82. Frit glass was applied to joint parts between the face plate 86, the support frame 82, and the rear plate 81 and was baked at 400° C. in the atmosphere for ten minutes, thereby effecting sealing thereof to form the panel (the envelope 88 in FIG. 12). The fixing of the substrate 71 to the rear plate 81 was also conducted with the frit glass.

In the present example numeral 74 of FIG. 12 denotes the electron-emitting devices before the formation of the electron-emitting region (for example, corresponding to FIG. 5B), and numerals 72, 73 the device wires in the X-direction and in the Y-direction, respectively.

The fluorescent film 84 was of the fluorescent materials in the stripe pattern (FIG. 13A), and the fluorescent film 84 was produced by first forming the black stripes, and then coating gap portions between them with the fluorescent materials 92 of the respective colors by the slurry process. The material for the black stripes was a material whose principal component was graphite commonly widely used.

The metal back 85 was provided on the inner surface side of the fluorescent film 84. The metal back 85 was made after fabrication of the fluorescent film 84 by carrying out the smoothing operation (normally called filming) of the internal surface of the fluorescent film 84 and thereafter depositing Al thereon by vacuum evaporation.

In certain cases the face plate 86 is provided with a transparent electrode (not illustrated) on the outer surface side of the fluorescent film 84 in order to enhance the electrical conduction property of the fluorescent film 84. However, the present example achieved the sufficient electric conduction property by only the metal back 85, and thus the transparent electrode was not provided.

On the occasion of the aforementioned sealing, sufficient position alignment was conducted in order to achieve correspondence between the devices and the fluorescent materials 92 of the respective colors in the color case.

The ambience in the panel completed as described above was evacuated through an exhaust pipe (not illustrated) by the vacuum pump. After a sufficient vacuum degree was accomplished, the forming operation of the conductive film 4 was carried out by applying the voltage between the device electrodes 2, 3 of the devices 74 through the external terminals Dox1-Doxm and Doy1-Doyn. The voltage waveform of the forming operation was the same as that shown in FIG. 6B.

In the present example the forming operation was carried out under a vacuum ambience of about $1.3\times10^{-3}$ Pa with T1 of 1 msec and T2 of 10 msec.

Then evacuation was carried on before the pressure in the panel reached the level of $10^{-6}$ Pa. Thereafter, tolunitrile was introduced through the exhaust pipe of the panel thereinto so that the total pressure became $1.3\times10^{-4}$ Pa. This state was maintained. The activation operation was then carried out by applying the voltage in the waveform shown in FIG. 8A under the conditions of T1 of 1 msec, T2 of 10 msec, and the maximum voltage of ±15 V between the device electrodes 2, 3 of the devices 74 through the external terminals Dox1-Doxm and Doy1-Doyn. At this time the voltage to the device electrode 3 was positive.

The forming and activation operations were carried out as described above to form the electron-emitting devices 74.

Then the whole panel was evacuated with heating at 250° C. and the temperature was then decreased to the room temperature. After the inside pressure was reduced to approximately $10^{-7}$ Pa, the exhaust pipe not illustrated was heated by a gas burner to be fused, thus effecting encapsulation of the envelope.

In the last step, in order to maintain the pressure after the encapsulation, a getter operation was carried out by high-frequency heating.

In the image displaying apparatus of the present example completed as described above, the scanning signal and modulation signal were applied each by the unrepresented signal generating means to each electron-emitting device through the external terminals Dox1-Doxm, Doy1-Doyn, whereby the devices emitted electrons. The high voltage of not less than 5 kV was applied to the metal back 85 through the high-voltage terminal 87 to accelerate the electron beams and to make the beams collide with the fluorescent film 84, so as to bring about excitation and luminescence thereof, thereby displaying the image.

As a result, the image-forming apparatus of the present example was able to stably display good images with high luminance over a long time.

Example 8

In the present example, the image-forming apparatus produced in Example 7 was driven by the driving circuit shown in FIG. 14 to achieve the display according to the TV signals of the NTSC system.

In the display apparatus of the present example, it is particularly easy to decrease the thickness of the display panel having the surface conduction electron-emitting devices as electron beam sources, and thus the depth of the display apparatus can be decreased. In addition, the display panel having the surface conduction electron-emitting devices as electron beam sources is readily formed in a large panel size, has high luminance, and is also excellent in field angle characteristics, so that the displaying apparatus of the present example can display images of strong appeal with full presence and with good visibility.

The displaying apparatus in the present example was able to stably display good TV images according to the TV signals of the NTSC system.

Example 9

The basic structure of the electron-emitting device in the present example is the same as that illustrated in the plan view and sectional view of FIG. 1A and FIG. 1B and in the enlarged plan view and sectional view of FIG. 2A and FIG. 2B.

The production method of the surface conduction electron-emitting device in the present example is fundamentally the same as that illustrated in FIGS. 5A to 5C and FIGS. 7A to 7D. The basic structure and production method of the device according to the present example will be described referring to FIGS. 1A, 1B, FIGS. 2A, 2B, FIGS. 5A to 5C, and FIGS. 7A to 7D.

The production method will be described below in order referring to FIGS. 1A, 1B, FIGS. 2A, 2B, FIGS. 5A to 5C, and FIGS. 7A to 7D.

(Step-a)

First, a photoresist (RD-2000N-41 available from Hitachi Kasei) was formed in the pattern expected to become the device electrodes 2, 3 and the desired gap L between the device electrodes on quartz substrate 1 after cleaned, and Ti and Pt were successively deposited in the thickness of 5 nm and in the thickness of 30 nm, respectively, by electron beam evaporation. Then the photoresist pattern was dissolved with an organic solvent and the Pt/Ti deposited films were lifted off, thereby forming the device electrodes 2, 3 having the device electrode gap L of 3 $\mu$m and the device electrode width W of 500 $\mu$m (FIG. 5A).

(Step-b)

A Cr film was deposited in the thickness 100 nm by vacuum evaporation and was patterned so as to form an aperture corresponding to the shape of the conductive film described hereinafter. An organic palladium compound solution (ccp4230 available from Okuno Seiyaku K.K.) was applied onto the film by spin coating with the spinner and it was baked at 300° C. for twelve minutes. The conductive film 4 containing fine particles of Pd as a principal element, thus made, had the thickness of 10 nm and the sheet resistance Rs of $2\times10^4$ Ω/□. The "film of fine particles" stated herein means a film of assemblage of fine particles, as described previously.

(Step-c)

The Cr film and the conductive. film 4 after baked were etched with an acid etchant, thereby forming the conductive film 4 in the width W' of 300 μm and in the desired pattern (FIG. 5B).

According to the above steps, the device electrodes 2, 3 and conductive film 4 were formed on the substrate 1.

The devices of Comparative Examples 9, 10 were also produced by the same steps.

(Step-d)

Then the device was set in the measurement-evaluation system of FIG. 4 and the inside was evacuated by the vacuum pump. After the pressure reached the vacuum level of $1\times10^{-6}$ Pa, the voltage was placed between the device electrodes 2, 3 of the device from the power supply 41 for applying the device voltage Vf to the device, thus carrying out the forming operation. This operation formed the second gap 7 in the conductive film. The voltage waveform in the forming operation was that shown in FIG. 6B (FIG. 5C or FIG. 7A).

In FIG. 6B, T1 and T2 indicate the pulse width and pulse spacing of the voltage waveform. In the present example, the forming operation was carried out under such conditions that T1 was 1 msec, T2 was 16.7 msec, and the peak values of the triangular waves were increased in steps of 0.1 V. During the forming operation a resistance measuring pulse at the voltage of 0.1 V was also interposed between the pulses for the forming and the resistance was measured thereby. The end of the forming operation was determined at the time when a measured value by the resistance measuring pulse became not less than about 1 MΩ and, at the same time, the application of the voltage to the device was terminated. The maximum voltage applied in the forming was about 5 V.

(Step-e)

For carrying out the activation step next, tolunitrile was introduced through the slow leak valve into the vacuum chamber and the pressure of $1.3\times10^{-4}$ Pa was maintained. Then the voltage as illustrated in FIG. 23 was applied via the device electrodes 2, 3 to the device after the forming operation in such a manner that the device electrode 2 was kept at 0 V while the voltage on the device electrode 3 was increased at a constant rate from 6 V to 15 V, thereafter kept at 15 V, and then inverted to −15 V, thus effecting the activation operation (FIG. 7A to FIG. 7D). At this time the voltage supplied to the device electrode 3 was positive, and the device current If was positive along the direction of flow from the device electrode 3 to the device electrode 2. After it was confirmed about 60 minutes after that the device current was in the region II of FIG. 9, the energization was stopped and the slow leak valve was closed, thereby terminating the activation operation.

On the other hand, activation under the following conditions was carried out on the devices of Comparative Examples 9 and 10 subjected to the same forming step as that of the device of the present example.

The device of Comparative Example 9: the same conditions as in the case of the device of the present example except that the partial pressure of introduction of tolunitrile was $1.3\times10^{-2}$ Pa.

The device of Comparative Example 10: the same conditions as in the case of the device of the present example except that the partial pressure of introduction of tolunitrile was $1.3\times10^{-6}$ Pa.

(Step-f)

Subsequently, the stabilization step was carried out. The vacuum chamber and electron-emitting device were heated by heater and evacuation of the inside of the vacuum chamber was carried on with maintaining the temperature at about 250° C. The heating by the heater was stopped 20 hours after and the temperature was decreased to the room temperature. The pressure inside the vacuum chamber at that time was approximately $1\times10^{-8}$ Pa.

Then the electron emission characteristics were measured.

The distance H between the anode electrode 44 and the electron-emitting device was set to 4 mm and the voltage of 1 kV was supplied from the high-voltage supply 43 to the anode electrode 44. In this state the rectangular pulse voltage with the peak value of 15 V was applied between the device electrodes 2, 3 by use of the power supply 41, and the device current If and emission current Ie were measured for each of the device of the present example and the devices of the comparative examples by use of the current meter 40 and current meter 42.

The device of the present example showed the following values; device current If=7.0 mA, emission current Ie=17.5 μA, and electron emission efficiency η(=Ie/If)=0.25%. The device of Comparative Example 9 showed the following values: device current If=7.0 mA, emission current Ie=5.0 μA, and electron emission efficiency η(=Ie/If)=0.07%. The device of Comparative Example 10 showed the following values: device current If=2.0 mA, emission current Ie=4.0 μA, and electron emission efficiency η(=Ie/If)=0.20%.

This result verified that the device of the present example had the greater emission current Ie and the higher electron emission efficiency η than the devices of the comparative examples.

The device of the present example and the devices of the comparative examples produced through the above steps were observed with the atomic force microscope (AFM) and the transmission electron microscope (TEM).

First, the morphology of the plane including the electron-emitting region 5 of the devices was observed with the atomic force microscope. The shape of the device of the present example was similar to the shape of the plane illustrated in FIG. 2A. Namely, the deposits 21*a*, 21*b* were observed on the both sides of the gap 7 formed in the conductive film 4. From information of height obtained by the atomic force microscope, the height of the highest portion of the deposits was about 80 nm high from the surface of the conductive film 4 and the deposits at that height had the beltlike shape having the width of about 500 nm. On the other hand, the deposits were also observed on the both sides of the second gap 7 formed in the conductive film 4 in the device of Comparative Example 9, as in the device of the present example, but the heights of the deposits were almost uniform and the beltlike shape observed in the device of the present example was not observed. When the device of Comparative Example 10 was observed, places with and without the deposits were scattered on the both sides of the second gap 7 formed in the conductive film 4.

Next, a cross section including the deposits of each device was observed using the transmission electron microscope.

From the result, the deposits near the gap 8 of the device of the present example had the shape similar to the shape shown in FIG. 2B and the height of the portions corresponding to the deposits 21*a*, 21*b* was about 80 nm. The deposit 21*a* was connected via the conductive film 4 to the device electrode 2 of FIGS. 1A and 1B, while the deposit 21*b* was connected via the conductive film 4 to the device electrode 3 of FIGS. 1A and 1B. The deposits were also formed on the conductive film 4 and their height was about 20 nm. The thickness of the part corresponding to the thickness D was further measured and the result was about 25 nm. The narrowest portion of the first gap 8 was present above the surface of the substrate and above the surface of the conductive film and the gap thereof (the distance between A and B in FIG. 2B) was about 4 nm.

The depth of the substrate-deteriorated portion (depressed portion) was about 30 nm and it was confirmed that carbon atoms also existed in the deteriorated portion. A cavity was observed in the central part.

On the other hand, in the device of Comparative Example 9, thick deposits covered the whole of the gap part formed in the conductive film and the shape as illustrated in FIG. 2B was not observed.

Further, in the device of Comparative Example 10, because a deposition amount of deposits was small, the precise shape thereof was not able to specify.

Finally, the deposits near the gap formed in the conductive film of the device of the present example was subjected to the element analysis with electron probe microanalysis (EPMA), X-ray photoelectron spectroscopy (XPS), and Auger electron spectroscopy, and it was verified that the deposits were the carbon films containing carbon as a matrix.

It was verified from these observation results that in the device of the present example the deposits 21*a*, 21*b* deposited were the carbon films containing graphite-like carbon as a matrix, carbon also existed in the substrate-deteriorated portion 22, the substrate-deteriorated portion 22 had the cavity in the central part thereof, and the device had the shape similar to that illustrated in FIG. 2B. Therefore, good electron emission was achieved with large emission current Ie and high emission efficiency η. Further, the devices of the present example and Comparative Examples 9, 10 were driven for the same time and it was verified that the devices of the comparative examples demonstrated earlier degradation of electron emission characteristics than the device of the present example, part of the devices of the comparative examples showed quick degradation of the device characteristics possibly due to discharge, and the device of the present example had stable characteristics with little degradation.

Example 10

In the present example the steps similar to those in Example 9 were carried out up to step-d. The substrate 1 was a Corning 7059 substrate.

(Step-e)

For carrying out the activation step next, acrylonitrile was introduced through the slow leak valve into the vacuum chamber and the pressure of $1.3\times10^{-2}$ Pa was maintained. Then the voltage was applied to the device after the forming operation in the waveform illustrated in FIG. 23; the voltage was increased from 6 V to 15 V and at the point of the voltage of +15 V the voltage was maintained, thereby effecting the activation operation (FIG. 7A to FIG. 7D). At this time the positive voltage was applied to the device electrode 3, while the voltage of 0 V to the device electrode 2. The device current If was positive along the direction of flow from the device electrode 3 to the device electrode 2. After it was confirmed that the applied voltage was the constant potential of 15 V and the device current was in the region II shown in FIG. 9 about 45 minutes after, the energization was stopped and the slow leak valve was closed, thus terminating the activation operation.

On the other hand, activation under the following conditions was carried out on the devices of Comparative Examples 11, 12 subjected to the same forming step as that of the device of the present example.

The device of Comparative Example 11: the same conditions as in the case of the device of the present example except that the partial pressure of introduction of acrylonitrile was 1.3 Pa.

The device of Comparative Example 12: the same conditions as in the case of the device of the present example except that the partial pressure of introduction of acrylonitrile was $1.3\times10^{-4}$ Pa.

(Step-f)

Subsequently, the stabilization step was carried out. The vacuum chamber and electron-emitting device were heated by heater and evacuation of the inside of the vacuum chamber was carried on with maintaining the temperature at about 250° C. The heating by the heater was stopped 20 hours after and the temperature was decreased to the room temperature. The pressure inside the vacuum chamber at that time was approximately $1\times10^{-8}$ Pa.

Then the electron emission characteristics were measured.

The distance H between the anode electrode 44 and the electron-emitting device was set to 4 mm and the voltage of 1 kV was supplied from the high-voltage supply 43 to the anode electrode 44. In this state the rectangular pulse voltage with the peak value of 15 V was applied between the device electrodes 2, 3 with the device electrode 2 being kept at 0 V and with the device electrode 3 being kept at 15 V by use of the power supply 41, and the device current If and emission current Ie were measured for each of the device of the present example and the devices of the comparative examples by use of the current meter 40 and current meter 42.

The device of the present example showed the following values; device current If=5.5 mA, emission current Ie=14.0 μA, and electron emission efficiency η(=Ie/If)=0.24%. The device of Comparative Example 11 showed the following values: device current If=7.5 mA, emission current Ie=5.5 μA, and electron emission efficiency η(=Ie/If)=0.07%. The device of Comparative Example 12 showed the following values: device current If=4.0 mA, emission current Ie=10.0 μA, and electron emission efficiency η(=Ie/If)=0.25%.

This result verified that the device of the present example had the greater emission current Ie and the higher electron emission efficiency η than the devices of the comparative examples.

The device of the present example produced through the above steps was observed with the atomic force microscope (AFM) and the transmission electron microscope (TEM) in a similar fashion as in Example 9. It was then verified that the shape of the device of the present example had the deposits 21*a*, 21*b* similar to those in the shape illustrated in FIGS. 3A and 3B. In the device of the present example the height of the portion corresponding to the deposit 21*a* in FIG. 3B was about 20 nm and the height of the portion corresponding to the deposit 21*b* was 60 nm. Further, the thickness of the part corresponding to the thickness D was measured and it was about 20 nm. The depth of the substrate-deteriorated portion was 40 nm and a cavity was observed in the center thereof. The narrowest portion of the first gap 8 was present above the surface of the substrate and above the surface of the conductive film and the gap thereof (the distance between A and B in FIG. 3B) was about 5 nm.

Then the probe was narrowed down in TEM and the element analysis of the substrate-deteriorated portion 22 was carried out by energy dispersive X-ray spectroscopy (EDS). The substrate-deteriorated portion 22 was compared with the substrate portion (non-deteriorated portion) under the conductive film 4 in the depth equivalent to the substrate-deteriorated portion 22 and it was verified that there was no change between ratios of Ba and Al in the substrate but Si in the substrate-deteriorated portion 22 was decreased to each of Ba and Al. Further, carbon was detected on the surface of the depressed portion as a cavity of the substrate-deteriorated portion.

Finally, the element analysis of the deposits 21*a*, 21*b* near the first gap 8 in the device of the present example was carried out with EDS, X-ray photoelectron spectroscopy (XPS), and Auger electron spectroscopy, and it was verified that the deposits were the carbon films containing carbon as a matrix.

It was verified from these observation results that in the device of the present example the deposits 21*a*, 21*b* were also the carbon films containing graphite-like carbon as a matrix and that the device had the shape similar to that illustrated in FIG. 3B. It was also verified that the substrate-deteriorated portion 22 had the cavity structure which contained carbon and from which Si had been consumed. From these results, good electron emission was achieved with high emission efficiency $\eta$. The device of the present example and the devices of Comparative Examples 11, 12 were driven under the same conditions for the same time and it was verified that the devices of the comparative examples demonstrated earlier degradation of the electron emission characteristics than the device of the present example, the phenomenon possibly due to discharge was observed in the devices of the comparative examples, and the device of the present example had very stable characteristics.

Example 11

The present example is an example of the image-forming apparatus with the electron source in which a lot of surface conduction electron-emitting devices are arrayed in the simple matrix configuration.

A plan view of a part of the electron source is illustrated in FIG. 17. A sectional view along the line 18—18 of FIG. 17 is illustrated in FIG. 18. In FIG. 17 and FIG. 18 the same symbols denote the same elements. Numeral 71 designates the substrate, 72 the X-directional wires (also called lower wires) corresponding to Dxm of FIG. 11, 73 the Y-directional wires (also called upper wires) corresponding to Dyn of FIG. 11, 4 the conductive film, 2 and 3 the device electrodes, 171 the interlayer insulation layer, and 172 a contact hole for electrical connection between the device electrode 2 and the lower wire 72.

The production method will be described in detail according to the sequence of steps by reference to FIGS. 19A to 19D and FIGS. 20A to 20D.

(Step-a)

On the substrate 71 in which a silicon oxide film 0.5 $\mu$m thick was deposited by sputtering on a soda lime glass sheet after cleaned, Cr and Au were successively deposited in the thickness of 5 nm and in the thickness of 0.6 $\mu$m, respectively, by vacuum evaporation and thereafter a photoresist (AZ1370 available from Heochst Inc.) was applied by spin coating with the spinner. Then the photoresist was baked and a photomask image was exposed and developed to form a resist pattern of the lower wires 72. Then the Au/Cr deposited film was wet-etched, thereby forming the lower wires 72 in the desired shape (FIG. 19A).

(Step-b)

Then the interlayer insulation layer 171 of a silicon oxide film was deposited in the thickness of 1.0 $\mu$m by RF sputtering (FIG. 19B).

(Step-c)

A photoresist pattern for formation of the contact holes 172 was made on the interlayer insulation layer 171 having been deposited in the step-b. Using this pattern as a mask, the interlayer insulation film 171 was etched to form the contact holes 172 therein (FIG. 19C).

(Step-d)

After that, a pattern expected to become the device electrodes 2, 3 and the device electrode gap L was formed with a photoresist (RD-2000N-41 available from Hitachi Kasei K.K.) and then Ti and Pt were successively deposited thereon in the thickness 5 nm and in the thickness 0.1 $\mu$m, respectively, by sputtering. The photoresist pattern was then dissolved with an organic solvent and the Pt/Ti deposited film was subjected to lift-off, thereby forming the device electrodes 2, 3 having the device electrode gap L=3 $\mu$m and the device electrode width W=0.3 mm (FIG. 19D).

(Step-e)

A photoresist pattern for the upper wires 73 was formed on the device electrodes 2, 3 and thereafter Ti and Au were successively deposited thereon in the thickness 5 nm and in the thickness 0.5 $\mu$m, respectively, by vacuum evaporation. Then unnecessary portions were removed by lift-off, thus forming the upper wires 73 in the desired shape (FIG. 20A).

(Step-f)

A Cr film 173 0.1 $\mu$m thick was deposited by vacuum evaporation and then patterned, an organic palladium compound solution (ccp4230 available from Okuno Seiyaku K.K.) was applied thereonto by spin coating with the spinner, and it was baked at 300° C. for ten minutes (FIG. 20B). The conductive film 4 thus made of Pd as a principal element had the thickness of 10 nm and the sheet resistance of $2\times10^4$ Ω/□.

(Step-g)

The Cr film 173 and the conductive film 4 after the baking were etched with an acid etchant and liftoff thereof was carried out, thereby forming the conductive film 4 in the desired pattern (FIG. 20C).

(Step-h)

A resist pattern was formed so as to coat portions other than the portions of contact holes 172 with a resist, and then Ti and Au were successively deposited thereon in the thickness 5 nm and in the thickness 0.5 $\mu$m, respectively, by vacuum evaporation. Then unnecessary portions were removed by lift-off, thereby filling the contact holes 172 (FIG. 20D).

According to the above steps, the lower wires 72, the interlayer insulation layer 171, the upper wires 73, the device electrodes 2, 3, and the conductive film 4 were formed on the insulating substrate 71.

Next described referring to FIG. 12 and FIG. 13A is an example of construction of an electron source and a display device using the electron source substrate produced as described above.

The substrate 71 having the devices fabricated as described above thereon was fixed on the rear plate 81, and the face plate 86 (in which the fluorescent film 84 and metal back 85 were formed on the inner surface of glass substrate 83) was placed 5 mm above the substrate 71 through the support frame 82. Frit glass was applied to joint parts between the face plate 86, the support frame 82, and the rear plate 81 and was baked at 400° C. in the atmosphere for ten minutes. The fixing of the substrate 71 to the rear plate 81 was also conducted with the frit glass.

In the present example numeral 74 of FIG. 12 denotes the electron-emitting devices before the formation of the electron-emitting region (for example, corresponding to FIG. 5B), and numerals 72, 73 the device wires in the X-direction and in the Y-direction, respectively.

The fluorescent film 84 is comprised of only the fluorescent material in the monochrome case, but the present example employed the stripe shape. The black stripes were formed first, and then gap portions between them were coated with the fluorescent materials of the respective colors to produce the fluorescent film 84. The material for the black stripes was a material whose principal component was graphite commonly widely used. A method for coating the glass substrate 83 with the fluorescent materials was the slurry process.

The metal back 85 is normally provided on the inner surface side of the fluorescent film 84. The metal back was made after fabrication of the fluorescent film by carrying out the smoothing operation (normally called filming) of the internal surface of the fluorescent film and thereafter depositing Al thereon by vacuum evaporation.

In certain cases the face plate 86 is provided with a transparent electrode (not illustrated) on the outer surface side of the fluorescent film 84 in order to enhance the electrical conduction property of the fluorescent film 84. However, the present example achieved the sufficient electric conduction property by only the metal back, and thus the transparent electrode was not provided.

On the occasion of the aforementioned sealing, sufficient position alignment was conducted in order to achieve correspondence between the electron-emitting devices and the fluorescent materials of the respective colors in the color case.

The ambience in the glass vessel completed as described above was evacuated through the exhaust pipe (not illustrated) by the vacuum pump. After a sufficient vacuum degree was accomplished, the forming operation of the conductive film 4 was carried out by applying the voltage between the device electrodes 2, 3 of the electron-emitting devices 74 through the external terminals Dox1–Doxm and Doy1–Doyn. The voltage waveform of the forming operation was the same as that shown in FIG. 6B. The maximum voltage applied in the forming was about 5 V.

In the present example the forming operation was carried out under a vacuum ambience of about $1.3\times10^{-3}$ Pa with T1 of 1 msec and T2 of 10 msec.

Then evacuation was carried on before the pressure in the panel reached the level of $10^{-6}$ Pa. Thereafter, tolunitrile was introduced through the exhaust pipe of the panel thereinto so that the total pressure became $1.3\times10^{-4}$ Pa. This state was maintained. The voltage was applied in the waveform similar to that of FIG. 23 between the electrodes 2, 3 of the electron-emitting devices 74 via the external terminals Dox1 to Doxm and Doy1 to Doyn in the following manner; the voltage was started to apply from 6 V, then was increased up to 20 V, and thereafter was maintained constant at 20 V. The activation operation was carried out while keeping the device electrode 2 at 0 V and applying the voltage to the device electrode 3 up to the maximum of 20 V.

The electron-emitting devices 74 were produced by carrying out the forming and activation operations as described above. The end of activation was determined by confirming that the applied voltage was constant (20 V) and the device current was in the region II in FIG. 9, as in Examples 9 and 10.

Then the whole panel was evacuated with heating at 250° C. and the temperature was then decreased to the room temperature. After the inside pressure was reduced to approximately $10^{-7}$ Pa, the exhaust pipe not illustrated was heated by a gas burner to be fused, thus effecting encapsulation of the envelope.

In the last step, in order to maintain the pressure after the encapsulation, a getter operation was carried out by high-frequency heating.

In the image displaying apparatus of the present invention completed as described above, the scanning signal and modulation signal were applied each by the unrepresented signal generating means to each electron-emitting device through the external terminals Dox1-Doxm, Doy1-Doyn, whereby the devices emitted electrons. The high voltage of not less than 5 kV was applied to the metal back 85 or the transparent electrode (not illustrated) through the high-voltage terminal 87 to accelerate the electron beams and to make the beams collide with the fluorescent film 84, so as to bring about excitation and luminescence thereof, thereby displaying the image.

The image displaying apparatus of the present example was able to stably display good images with high luminance over a long time.

Example 12

The present example is an example of displaying apparatus so constructed as to display image information provided from various image information sources including television broadcasting. The image-forming apparatus produced in Example 11 and shown in FIG. 12 was driven by the driving circuit shown in FIG. 14 to achieve the display according to the TV signals of the NTSC system.

In the display apparatus of the present example, it is particularly easy to decrease the thickness of the display panel having the surface conduction electron-emitting devices as electron beam sources, and thus the depth of the display apparatus can be decreased. In addition, the display panel having the surface conduction electron-emitting devices as electron beam sources is readily formed in a large panel size, has high luminance, and is also excellent in field angle characteristics, so that the displaying apparatus of the present example can display images of strong appeal with full presence and with good visibility.

The displaying apparatus in the present example was able to stably display good TV images according to the TV signals of the NTSC system.

As described above, the electron-emitting device of the present invention is constructed in such structure that the nearest portion of the carbon films opposed to each other on the both sides of the gap is located above the substrate and the conductive film in the direction normal to the surface of the substrate; this decreases the amount of electrons that drop onto the carbon film or the conductive film or the device electrode on the application side of the higher voltage with the gap as a border to be absorbed and become part of the device current (If) during the driving of the electron-emitting device, but increases the amount of electrons reaching the anode electrode (emission current Ie). Therefore, the device was obtained with high efficiency. At the same time, it can weaken the effective intensity of the electric field applied to the surface of the substrate located at the first gap part. This can achieve stable electron emission over a long period.

Since at least the substrate exposed in the gap part has the depressed portion, the creepage distance is further increased between the carbon films opposed to each other on the both sides of the gap, depending upon the depth of the depressed portion. This yields the device with high efficiency in which the device current If is restrained. At the same time, the device obtained was the stable device in which the degradation of characteristics possibly due to the discharge phenomenon at the gap was able to restrain even under the strong electric field between the carbon films as described previously.

Further, it is assumed that the surface of the substrate exposed in the gap is exposed to irradiation of emitted electrons. In the device of the present invention, since carbon is present, at least, on the surface of the depressed portion of the substrate exposed in the gap part, it can suppress the variation and degradation of device characteristics possibly due to the decrease of charging on the surface of the depressed portion of the substrate, induced by the irradiation of electrons. Therefore, the device was obtained with stable electron emission characteristics over a long period.

Further, when the electron source or the image-forming apparatus is constructed using the electron-emitting devices of the present invention with high efficiency and stable characteristics over a long period, the efficiency is high and the devices are very stable even in the case of the array of many electron-emitting devices. Particularly, when the image display apparatus was constructed with the fluorescent material, the image display apparatus was obtained with high luminance, with stability over a long period, and with low power consumption.

What is claimed is:

1. An electron-emitting device comprising:

first and second electrodes arranged on a surface of a substrate;

first and second carbon films; and a voltage source, for applying a voltage between said first electrode and said second electrode, to emit electrons, wherein a first end of said first carbon film is electrically connected to said first electrode, a first end of said second carbon film is electrically connected to said second electrode, a second end of said first carbon film and a second end of said second carbon film are disposed in opposition to each other across a gap, the second end of said first carbon film being more distant from the surface of the substrate than the second end of said second carbon film, and said voltage source applies a potential greater than a potential of the second electrode to said first electrode in order to emit electrons, wherein the surface of the substrate is concaved at a section within the gap.

2. An electron-emitting device according to claim 1, wherein a section at which the surface of the substrate is concaved contains carbon.

3. An electron-emitting device comprising:

first and second electrodes arranged on a surface of a substrate;

first and second carbon films; and a voltage source, for applying a voltage between said first electrode and said second electrode to emit electrons, wherein said first carbon film is electrically connected to said first electrode, said second carbon film is electrically connected to said second electrode, said first carbon film and said second carbon film are disposed in opposition to each other across a gap, an end of said first carbon film being more distant from said surface of said substrate than an end of said second carbon film, and said voltage source applies a potential greater than a potential of the second electrode to said first electrode in order to emit electrons, wherein the surface of the substrate is concaved at a section within the gap.

4. An electron-emitting device according to claim 3, wherein a section at which the surface of the substrate is concaved contains carbon.

5. An electron-source comprising a plurality of electron-emitting devices, wherein each of the electron-emitting devices is an electron-emitting device according to any one of claims 1–4.

6. An image forming apparatus comprising an electron source and an image forming member, wherein the electron source is an electron source according to claim 5.

7. A computer comprising:

an image forming apparatus according to claim 6; and a driver for driving each of the electron-emitting devices.

* * * * *